US009558635B2

(12) United States Patent
Aoki et al.

(10) Patent No.: US 9,558,635 B2
(45) Date of Patent: Jan. 31, 2017

(54) GAMING MACHINE HAVING HYBRID ART GLASS

(71) Applicant: WMS Gaming Inc., Waukegan, IL (US)

(72) Inventors: Dion K. Aoki, Chicago, IL (US); Christian L. Castro, Chicago, IL (US); Joel R. Jaffe, Glenview, IL (US); Paul M. Lesley, Blue Island, IL (US); Timothy C. Loose, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 262 days.

(21) Appl. No.: 14/467,572

(22) Filed: Aug. 25, 2014

(65) Prior Publication Data

US 2015/0072758 A1 Mar. 12, 2015

Related U.S. Application Data

(60) Provisional application No. 61/876,508, filed on Sep. 11, 2013.

(51) Int. Cl.
*G07F 17/34* (2006.01)
*G07F 17/32* (2006.01)

(52) U.S. Cl.
CPC ..... *G07F 17/34* (2013.01); *G07F 17/3211* (2013.01)

(58) Field of Classification Search
CPC ..... G07F 17/34; G07F 17/3211
See application file for complete search history.

(56) References Cited

U.S. PATENT DOCUMENTS 5,123,649 A * 6/1992 Tiberio ..... G07F 17/3244 273/143 R
6,368,216 B1 * 4/2002 Hedrick ..... G07F 17/3211 463/20
6,517,433 B2 2/2003 Loose et al.
6,945,685 B1 9/2005 Sokolov et al.
6,976,915 B2 * 12/2005 Baker ..... G07F 17/3211 40/564
7,297,058 B2 11/2007 Gomez et al.
7,309,284 B2 * 12/2007 Griswold ..... G07F 17/32 463/16
7,413,512 B2 8/2008 Mattice et al.
7,442,125 B2 10/2008 Paulsen et al.
7,470,194 B2 12/2008 Gomez et al.
7,594,852 B2 9/2009 Rasmussen
7,883,421 B2 2/2011 Moore et al.
7,915,831 B2 3/2011 Allitt et al.
8,057,303 B2 11/2011 Rasmussen et al.
8,118,670 B2 2/2012 Griswold et al.
8,118,674 B2 2/2012 Burak et al.
(Continued)

FOREIGN PATENT DOCUMENTS

WO WO 01/35017 A1 5/2001
WO WO 2006/036486 A1 4/2006
WO WO 2006/124976 A1 11/2006

*Primary Examiner* — Corbett B Coburn
(74) *Attorney, Agent, or Firm* — Nixon Peabody LLP

(57) ABSTRACT

A gaming terminal for conducting a wagering game includes a gaming cabinet, a video display, and an art panel. The video display is positioned within the gaming cabinet and is configured to display content associated with the wagering game. The art panel is positioned within the gaming cabinet and overlays the video display such that a first region of the art panel is illuminated by the video display.

18 Claims, 19 Drawing Sheets

(56) References Cited

U.S. PATENT DOCUMENTS

| | | | | |
|---|---|---|---|---|
| 8,243,217 | B2 * | 8/2012 | Pelfrey | G02F 1/1334 349/16 |
| 8,282,257 | B2 | 10/2012 | Rasmussen | |
| 8,323,113 | B2 | 12/2012 | Kaminkow et al. | |
| 8,416,150 | B2 | 4/2013 | Paul et al. | |
| 8,663,758 | B2 | 3/2014 | Bezek et al. | |
| 2004/0171423 | A1 * | 9/2004 | Silva | G07F 17/3211 463/31 |
| 2005/0261057 | A1 * | 11/2005 | Bleich | G07F 17/3202 463/30 |
| 2007/0279538 | A1 * | 12/2007 | Thomas | G07F 17/3211 349/1 |
| 2008/0020841 | A1 | 1/2008 | Wells et al. | |
| 2008/0227527 | A1 * | 9/2008 | Canterbury | G07F 17/32 463/20 |
| 2011/0070948 | A1 | 3/2011 | Bainbridge et al. | |
| 2011/0319152 | A1 * | 12/2011 | Ross | G07F 17/3202 463/20 |
| 2012/0122549 | A1 | 5/2012 | Rasmussen et al. | |
| 2012/0270648 | A1 * | 10/2012 | Rasmussen | G07F 17/3211 463/30 |
| 2012/0322564 | A1 | 12/2012 | Granger et al. | |

* cited by examiner

GAMING MACHINE HAVING HYBRID ART GLASS

CROSS-REFERENCE TO RELATED APPLICATIONS

This application claims the benefit of U.S. Provisional Application No. 61/876,508, filed Sep. 11, 2013, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering games and, more particularly, to a gaming machine having a hybrid art-panel-display assembly.

BACKGROUND

Gaming machines or terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing terminals and the expectation of winning each terminal is roughly the same (or believed to be the same), players are most likely to be attracted to the more entertaining and exciting terminal. As a result, wagering game machine operators strive to employ the most entertaining and exciting machines available, because such machines attract frequent play and provide increased profitability for the operators.

SUMMARY OF THE INVENTION

According to some implementations of the present disclosure, a gaming terminal for conducting a wagering game includes a gaming cabinet, a video display, and an art panel. The video display is positioned within the gaming cabinet and is setup to display content associated with the wagering game. The art panel is positioned within the gaming cabinet and overlays the video display such that a first region of the art panel is illuminated by the video display.

According to some implementations of the present disclosure, a gaming terminal for conducting a wagering game includes a gaming cabinet, one or more symbol bearing reels, a video display, and an art panel. The gaming cabinet includes a first portion and a second portion positioned above the first portion. The one or more symbol bearing reels are positioned within the first portion of the gaming cabinet and are able to indicate randomly selected outcomes for the wagering game. The video display is positioned within the second portion of the gaming cabinet and is setup to display content associated with the wagering game. The art panel is positioned within the second portion of the gaming cabinet and overlays the video display such that at least a first region of the art panel is backlit by the video display.

According to some implementations of the present disclosure, a gaming terminal for conducting a wagering game includes a gaming cabinet, one or more symbol bearing reels, a video display, one or more illumination devices, and an art panel. The gaming cabinet includes a first portion and a second portion positioned above the first portion. The one or more symbol bearing reels are positioned within the first portion of the gaming cabinet and are able to indicate randomly selected outcomes for the wagering game. The video display is positioned within the second portion of the gaming cabinet and is setup to display content associated with the wagering game. The one or more illumination devices are positioned within the second portion of the gaming cabinet and are setup to emit light. The art panel is positioned within the second portion of the gaming cabinet and overlays the video display and the one or more illumination devices such that a first region of the art panel is illuminated by the video display and a second region of the art panel is illuminated by the one or more illumination devices.

Additional aspects of the present disclosure will be apparent to those of ordinary skill in the art in view of the detailed description of various implementations, which is made with reference to the drawings, a brief description of which is provided below.

Figure 1:
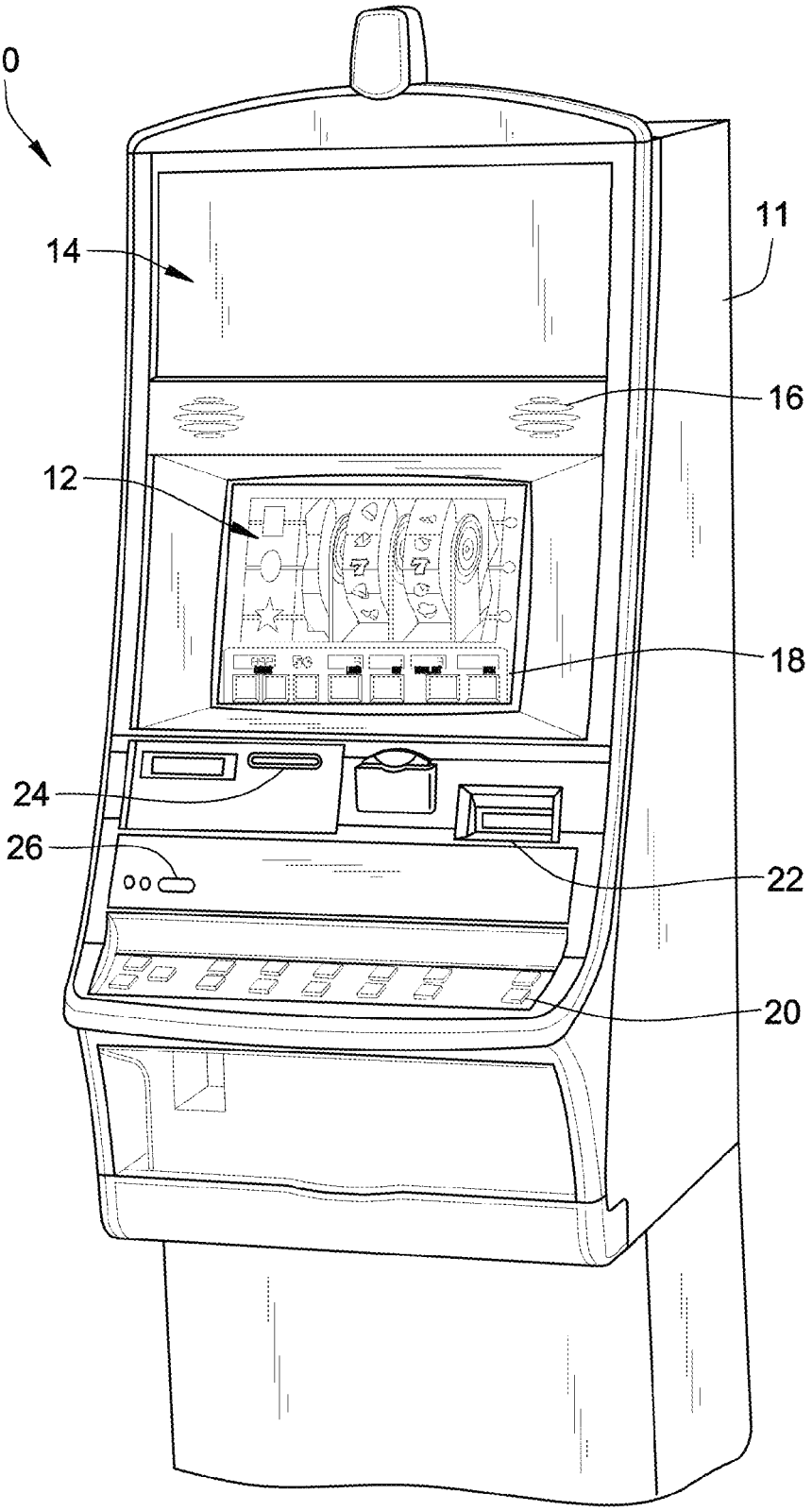
FIG. 1 is a perspective view of a free-standing gaming terminal according to some aspects of the present disclosure.

While the present disclosure is susceptible to various modifications and alternative forms, specific implementations have been shown by way of example in the drawings and will be described in detail herein. It should be understood, however, that the present disclosure is not intended to be limited to the particular forms disclosed. Rather, the disclosure is to cover all modifications, equivalents, and alternatives falling within the spirit and scope of the present invention as defined by the appended claims.

DETAILED DESCRIPTION

While this disclosure is susceptible of implementation in many different forms, there is shown in the drawings and will herein be described in detail preferred implementations of the disclosure with the understanding that the present disclosure is to be considered as an exemplification of the principles of the disclosure and is not intended to limit the broad aspect of the disclosure to the implementations illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some implementations, the wagering game may involve wagers of real money, as found with typical land-based or on-line casino games. In other implementations, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0062196 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
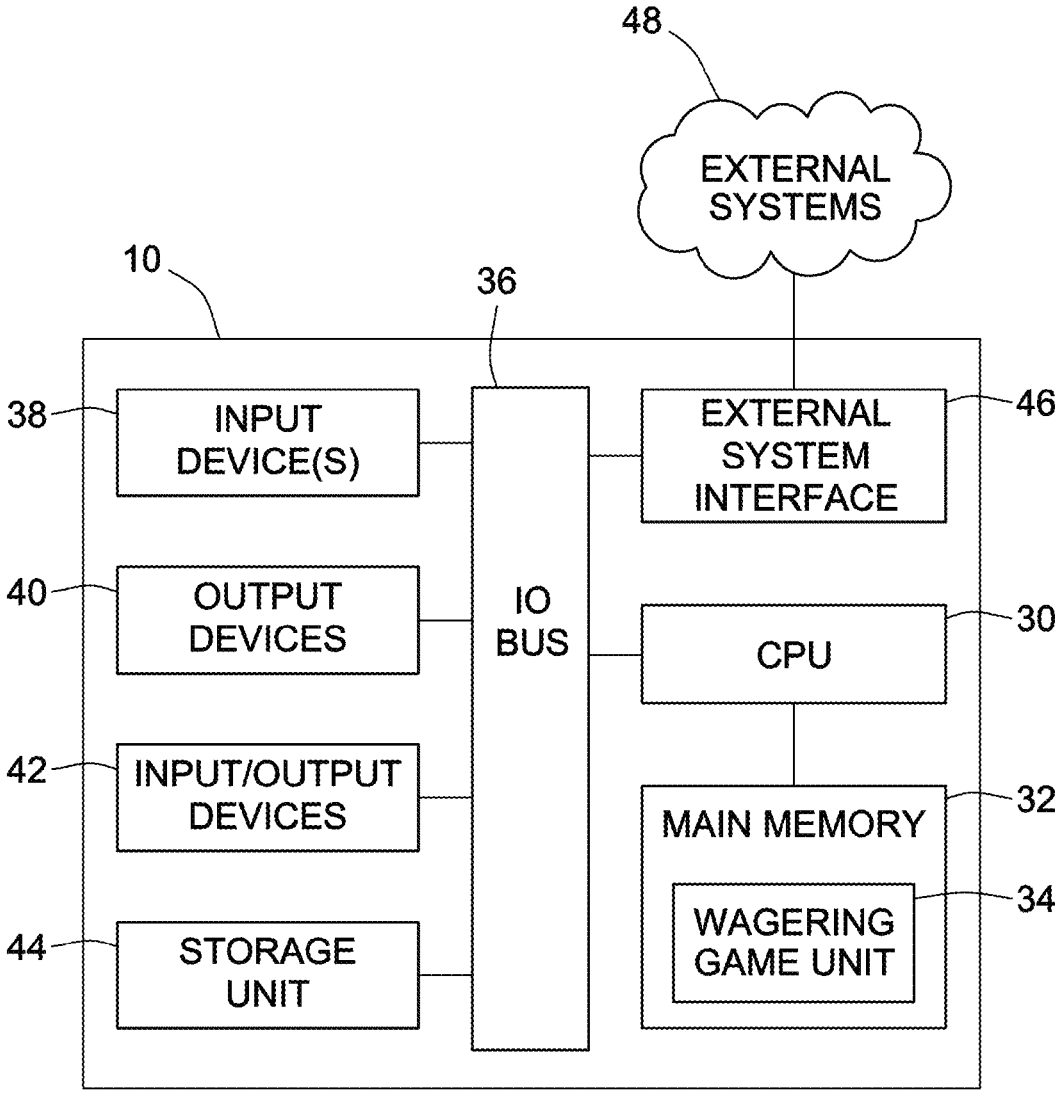
FIG. 2 is a schematic view of a gaming system according to some aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
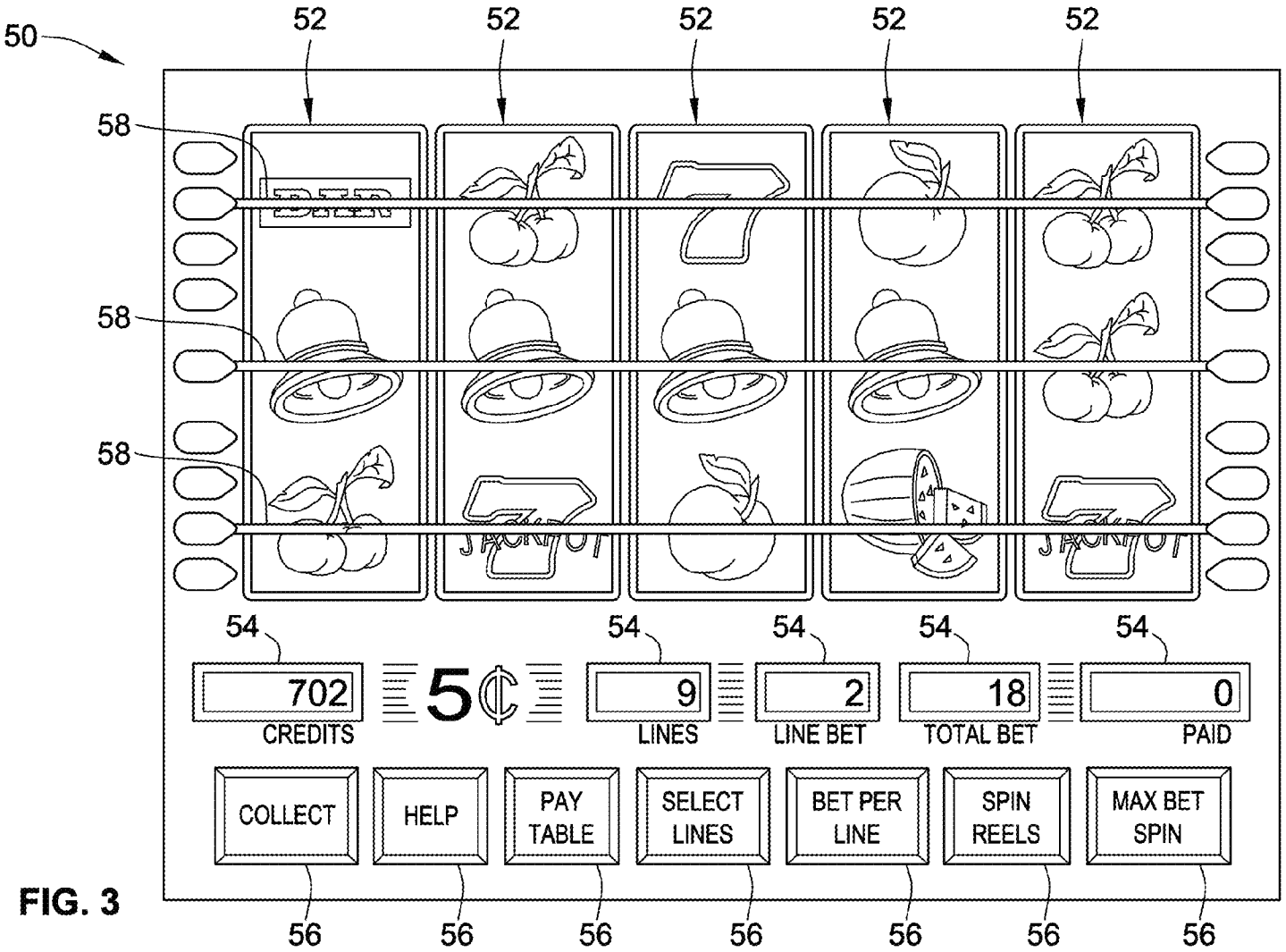
FIG. 3 is an image of an exemplary basic-game screen of a wagering game displayed on a gaming terminal according to some aspects of the present disclosure.

Referring now to FIG. 3, there is illustrated an image of a basic-game screen 50 adapted to be displayed on the primary display area 12 or the secondary display area 14. The basic-game screen 50 portrays a plurality of mechanical reels 52. Alternatively or additionally, the basic-game screen 50 portrays a plurality of simulated symbol-bearing reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game (e.g., using the plurality of mechanical reels 52).

In response to receiving a wager, the reels 52 are rotated and stopped to place symbols on the reels in visual association with paylines such as paylines 58. The wagering game evaluates the displayed array of symbols on the stopped reels 52 and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game (e.g., using the plurality of mechanical reels 52 to display the wagering game outcome). The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14, the plurality of mechanical reels 52, etc.) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magnetooptical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12 and/or the plurality of mechanical reels 52, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
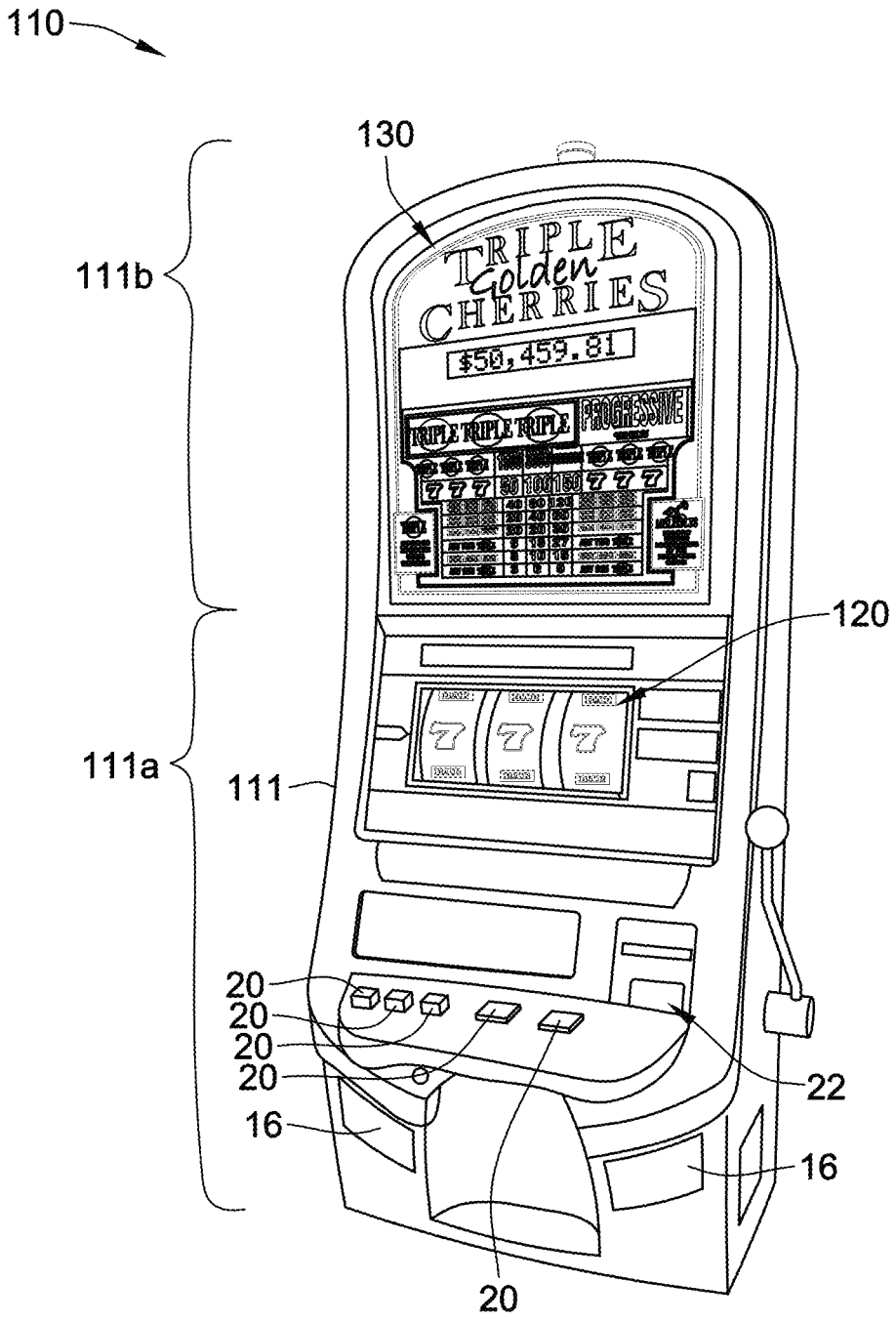
FIG. 4 is a perspective view of a free-standing gaming terminal according to some aspects of the present disclosure.

Referring to FIG. 4, a gaming terminal 110 for conducting a wagering game is shown, which is similar to the gaming terminal 10 described above, where like reference numbers are used for like components. The gaming terminal 110 includes a gaming cabinet 111, one or more symbol bearing reels 120, and a hybrid art-panel-display assembly 130.

The gaming cabinet 111 includes a first portion 111*a* and a second portion 111*b*. The second portion 111*b* of the gaming cabinet 111 is positioned above the first portion 111*a* of the gaming cabinet 111. The first portion 111*a* of the gaming cabinet 111 can also be referred to as and/or include therein a primary display area, such as, for example, the primary display area 12 of the gaming terminal 10. The second portion 111*b* of the gaming cabinet 111 can also be referred to as and/or include therein a secondary display area, such as, for example, the secondary display area 14 of the gaming terminal 10.

The one or more symbol bearing reels 120 are positioned within the first portion 111*a* of the gaming cabinet 111 and are the same as, or similar to, the mechanical reels 52 (FIG. 3) of the gaming terminal 10. Alternatively, the one or more symbol bearing reels 120 can be simulated reels displayed on a display device (e.g., a television such as a plasma television, a computer monitor such as an LED computer monitor, etc.) positioned within the first portion 111*a* of the gaming cabinet 111. Whether the one or more symbol bearing reels 120 are mechanical or simulated, the one or more symbol bearing reels 120 are configured to indicate randomly selected outcomes for a wagering game being conducted using the gaming terminal 110. In particular, the one or more symbol bearing reels 120 spin and stop, thereby revealing an array of symbols that is evaluated to determine if a winning outcome is achieved.

Figure 5A:
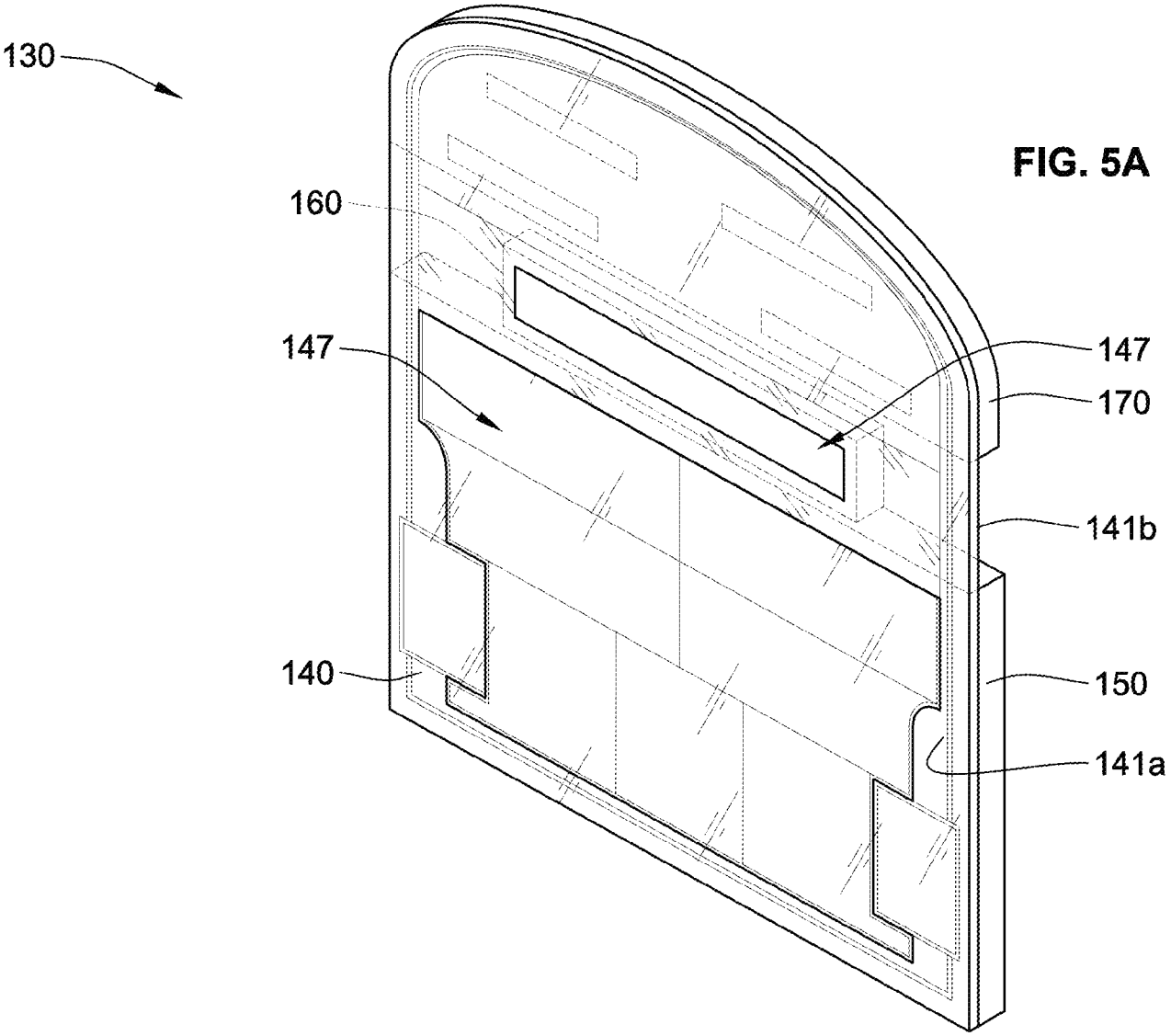
FIG. 5A is an assembled perspective view of a hybrid art-panel-display assembly of the gaming terminal of FIG. 4 according to some aspects of the present disclosure.
Figure 5B:
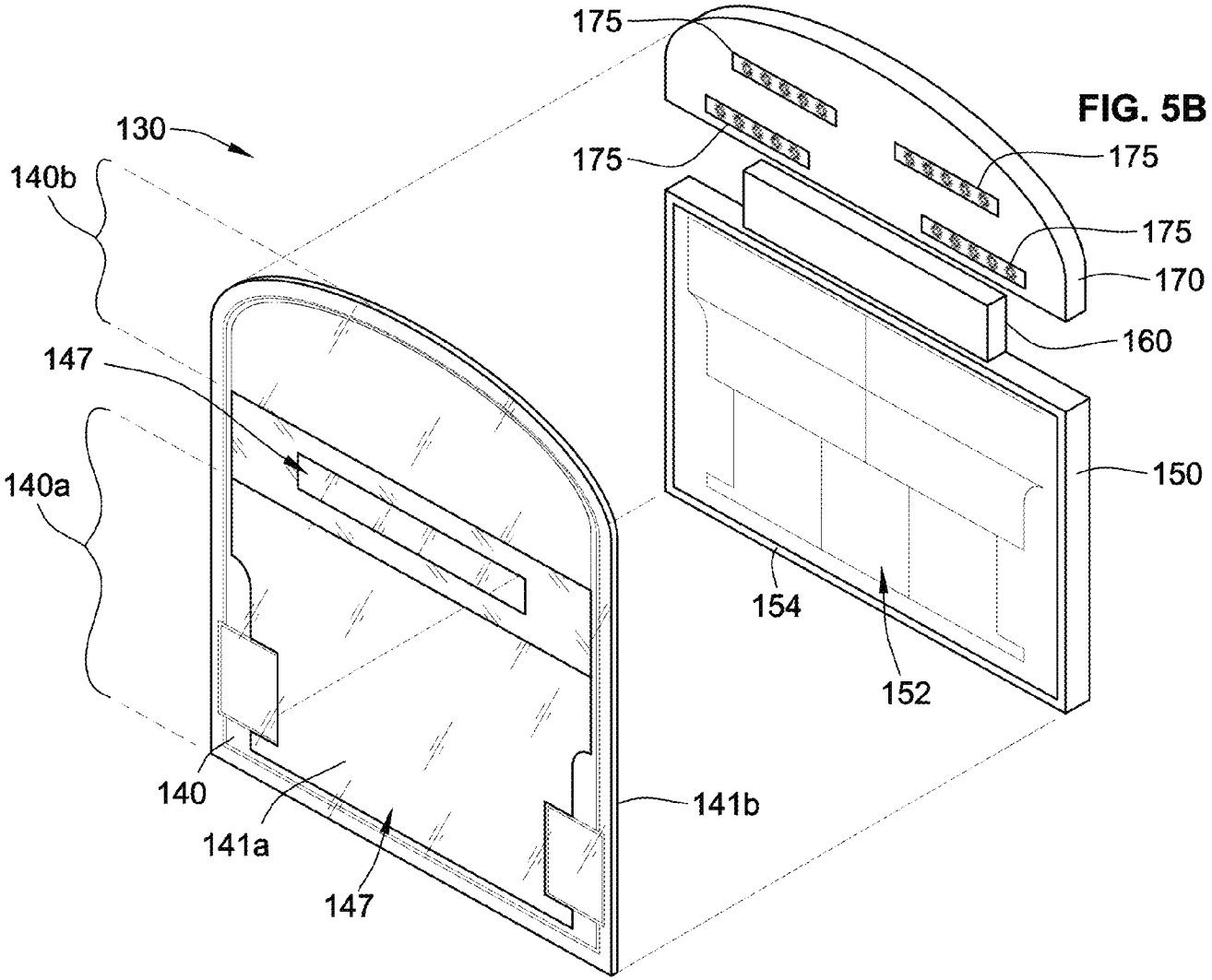
FIG. 5B is an exploded perspective view of the hybrid art-panel-display assembly of FIG. 5A.
Figure 6A:
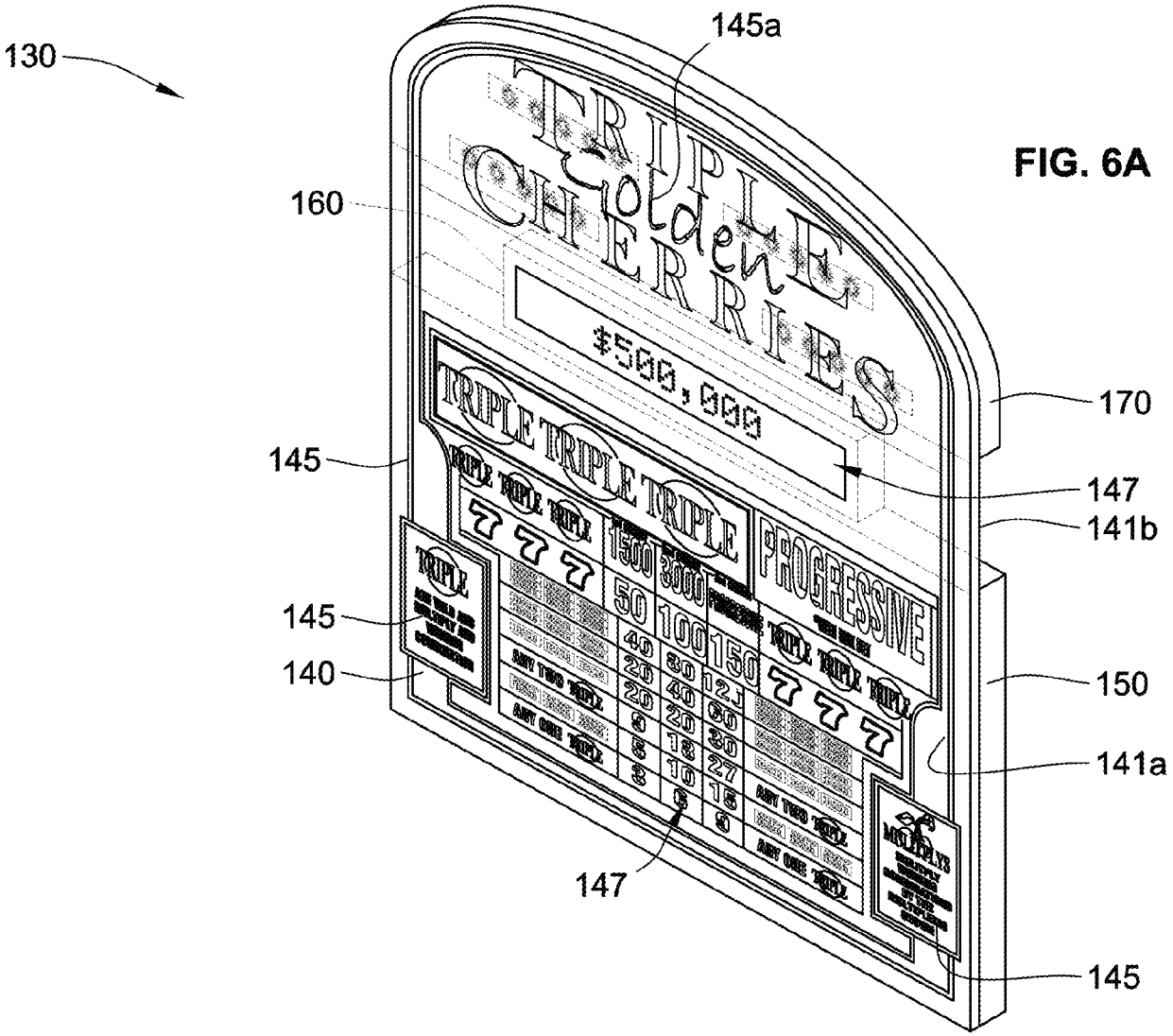
FIG. 6A is an assembled perspective view of a hybrid art-panel-display assembly of the gaming terminal of FIG. 4 according to some aspects of the present disclosure.
Figure 6B:
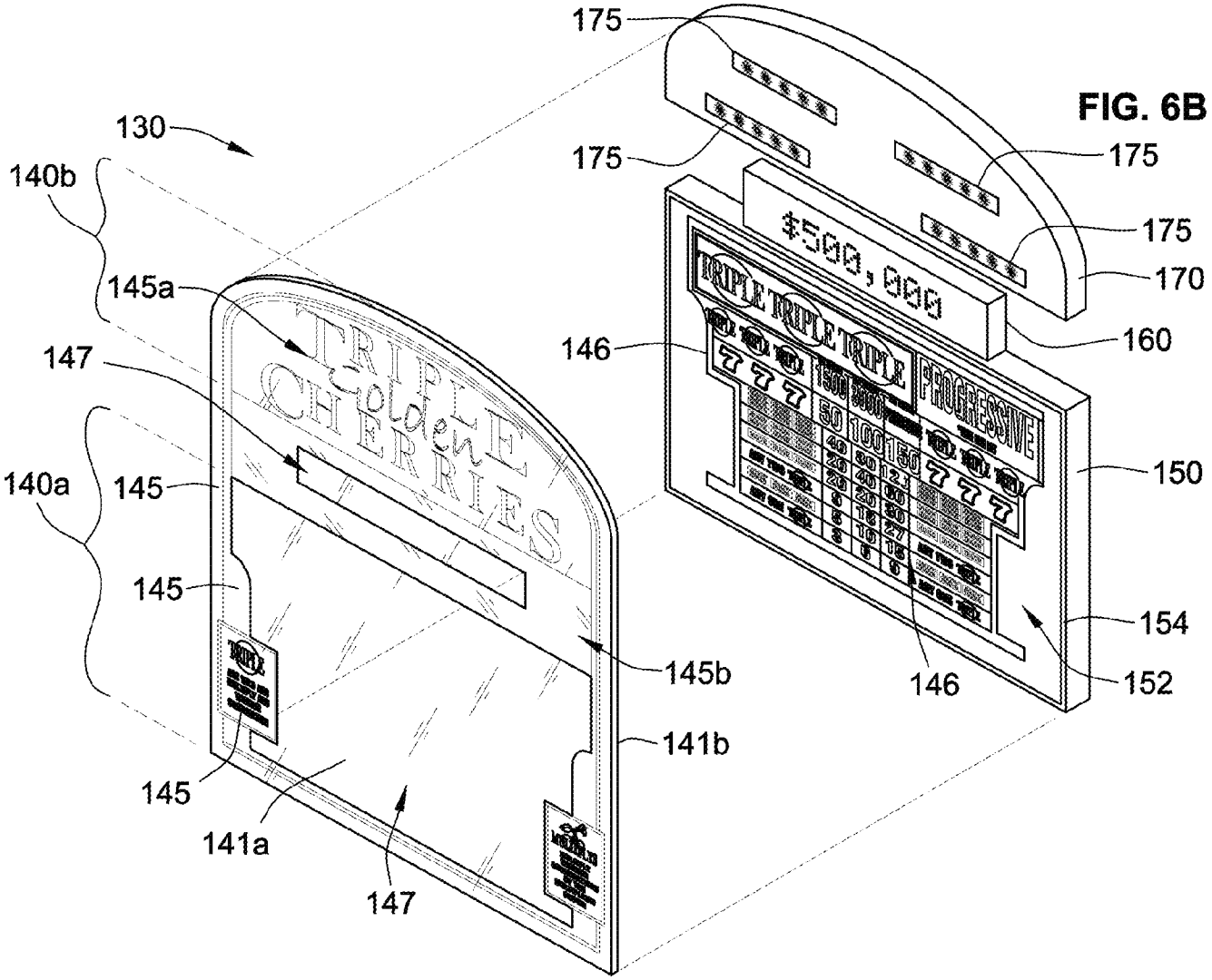
FIG. 6B is an exploded perspective view of the hybrid art-panel-display assembly of FIG. 6A.

As best shown in FIGS. 5B and 6B, the hybrid art-panel-display assembly 130 includes an art panel 140, a video display 150, a progressive meter 160, and a light panel 170.

A generic version of the hybrid art-panel-display assembly 130 is shown in FIGS. 5A-5E. By generic version it is meant that detailed and/or extensive indicia (e.g., thematic symbols, game title, rules, warnings, etc.) are not included on the art panel 140 of the hybrid art-panel-display assembly 130 and that detailed and/or extensive content (e.g., pay tables, rules, warnings, thematic symbols, game title, etc.) is not displayed on the video display 150 of the hybrid art-panel-display assembly 130. Rather, blank areas with minimal borders of the art panel 140 and the video display 150 are shown in FIGS. 5A-5E.

A non-generic version of the hybrid art-panel-display assembly 130 is shown in FIGS. 6A-6E. By non-generic version it is meant that exemplary detailed and/or extensive indicia 145 (e.g., thematic symbols, borders, game title, rules, warnings, etc.) are included on the art panel 140 of the hybrid art-panel-display assembly 130 and that exemplary detailed and/or extensive content 146 (e.g., pay tables, rules, warnings, borders, thematic symbols, game title, etc.) is displayed on the video display 150 of the hybrid art-panel-display assembly 130.

A comparison of the implementation of FIGS. 5A-5E with the implementation of FIGS. 6A-6E highlights the indicia 145 and content 146 that can be included and/or displayed on the hybrid art-panel-display assembly 130 and where such indicia 145 and content 146 can be positioned. Of course, the indicia 145 and the content 146 in FIGS. 6A-6E is exemplary and can be rearranged, supplemented, and/or replaced with any other combination of indicia and content for any number of other wagering games.

The art panel 140 (best shown in FIGS. 5B and 6B) can be made of one or more sheets of glass, one or more sheets of plastic, or a combination thereof. In some implementations, the art panel 140 is a single, solid sheet of Plexiglas. As best shown in FIGS. 6B and 6C, the art panel 140 can include one or more indicia 145 applied to and/or printed thereon. As the art panel 140 of the implementation shown in FIGS. 5A-5E is a generic art panel with no indicia, a comparison of FIG. 6C with FIG. 5C highlights the exemplary detailed and/or extensive indicia 145 included on the art panel 140 in the implementation shown in FIGS. 6A-6E.

The indicia 145 can be applied to and/or printed on the art panel 140 in a number of manners. For example, the indicia 145 can be printed (directly or indirectly) on the art panel 140, the indicia 145 can be on a sticker that is applied (directly or indirectly) to the art panel 140, the indicia 145 can be directly etched (e.g., acid etched, milled, etc.) into a surface of the art panel 140, the indicia 145 can be painted and/or drawn (directly or indirectly) on the art panel 140, or any combination thereof.

The indicia 145 can include any type or kind of indicia, such as, for example, thematic symbols, a title of the wagering game, borders, rules associated with the wagering game, warnings associated with the wagering game, mirrors or other reflective surfaces, stickers, two dimensional indicia, three dimensional indicia (e.g., the indicia can extend out from a front surface 141*a* of the art panel and form shapes such as partial spheres, pyramids, loops, hoops, light guides, etc.), etc. Some of the indicia 145 can be opaque (e.g., block substantially all light from being transmitted therethrough), some of the indicia 145 can be transparent (e.g., permit at least some light to be transmitted therethrough), and some of the indicia 145 can be a combination thereof (e.g., partially opaque and partially transparent). In some implementations, the indicia 145 can block light from transmitting therethrough in a first direction, but permit light to transmit therethrough in the opposite direction (e.g., a one way mirror).

The indicia 145 can be applied to and/or printed anywhere on the front surface 141*a* of the art panel 140, a back surface

141*b* of the art panel 140, or a combination thereof. For example, as shown in FIGS. 6B, 6C, and 6E, a game title indicium 145*a* (e.g., "Triple Golden Cherries") can be applied to and/or can be printed on the front surface 141*a* of the art panel 140 and a mirrored indicium 145*b* (e.g., a reflective surface and/or layer) can be applied to and/or printed on the back surface 141*b* of the art panel 140. The indicia 145 can be positioned anywhere on the art panel 140. In some implementations, the indicia 145 are used to mask less aesthetically pleasing areas behind the art panel 140 (e.g., a border or housing 154—shown in FIGS. 5B and 6B—of the video display 150 can be masked by the indicia 145 on the art panel 140).

Figure 5C:
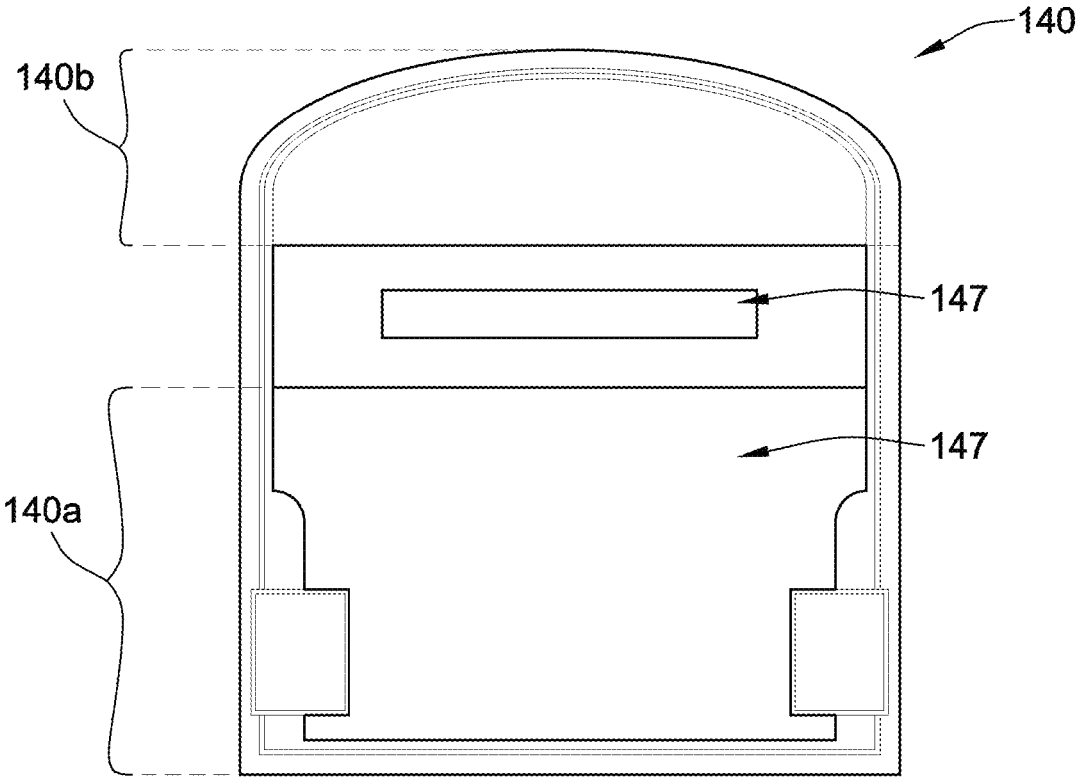
FIG. 5C is a front view of an art panel of the hybrid art-panel-display assembly of FIG. 5A.
Figure 5D:
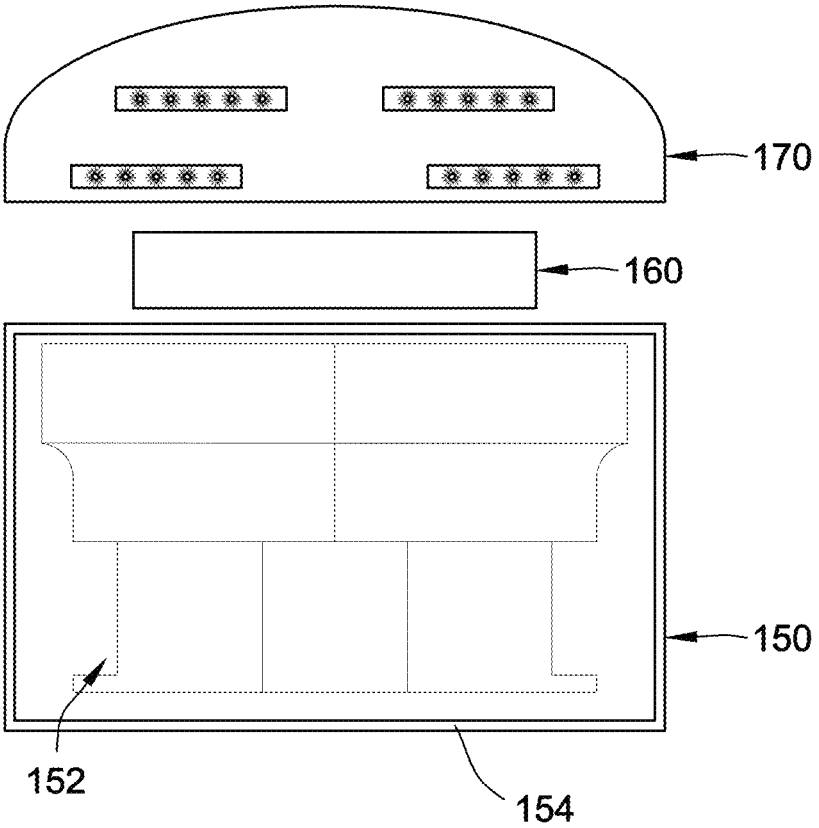
FIG. 5D is a front view of a video display, a progressive meter, and a light panel of the hybrid art-panel-display assembly of FIG. 5A.
Figure 5E:
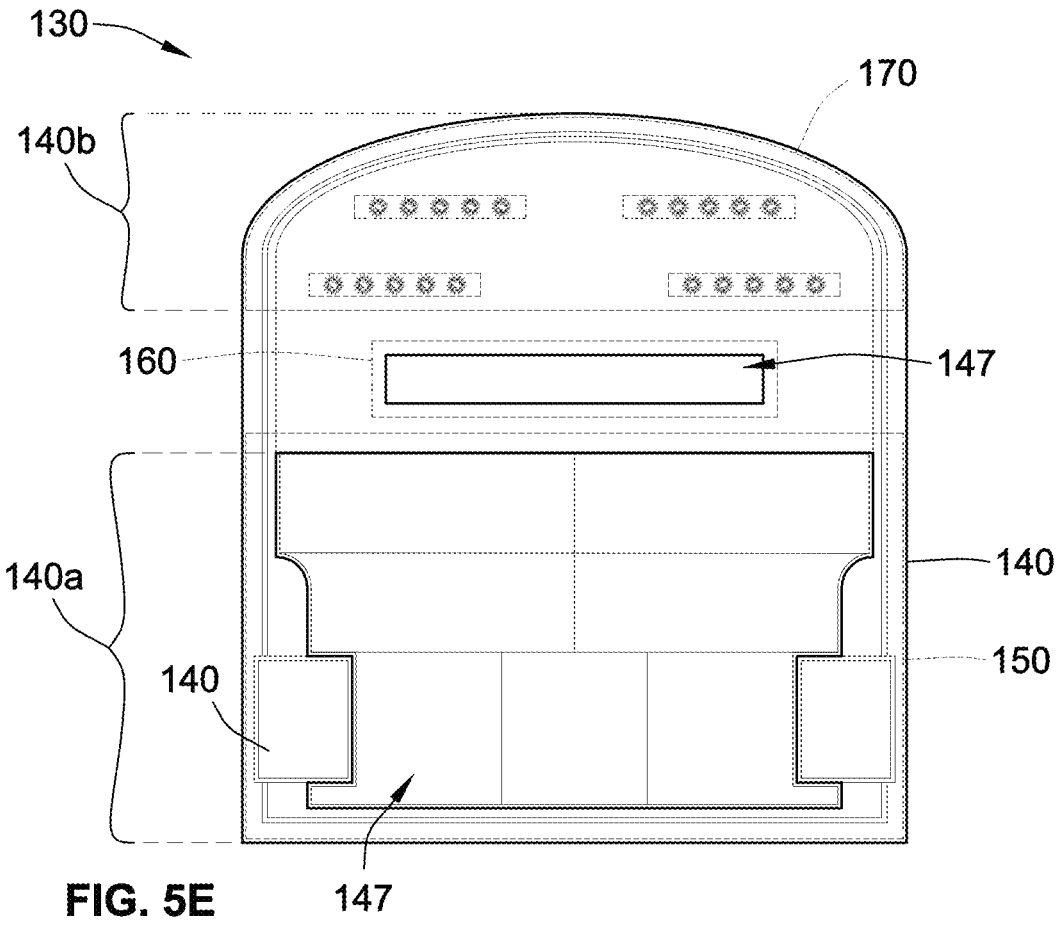
FIG. 5E is an assembled front view of the hybrid art-panel-display assembly of FIG. 5A.
Figure 6C:
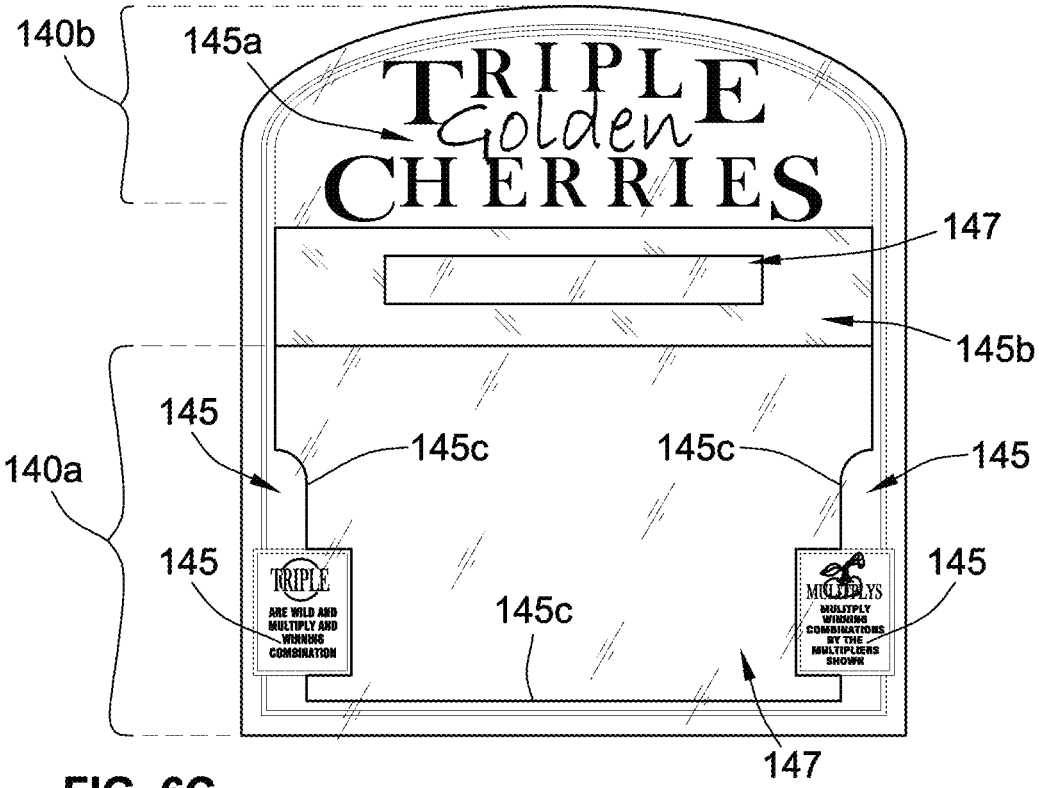
FIG. 6C is a front view of an art panel of the hybrid art-panel-display assembly of FIG. 6A.

As best shown in FIGS. 5C and 6C, the art panel 140 has one or more clear portions 147 positioned such that components (e.g., at least a portion of the video display 150, at least a portion of the progressive meter 160) of the gaming terminal 110 positioned behind the art panel 140 can be readily viewed by a player of the gaming terminal 110. By clear portion 147 of the art panel 140 it is meant that the portion of the art panel 140 is transparent (e.g., like a clear glass or plastic window) and that any indicia in that area of the art panel 140, if any, are at least partially transparent. In some implementations, the clear portions 147 lack indicia altogether and are bare (e.g., bare glass window or bare plastic window). For example, as best shown in FIG. 6E, a major portion of a display of the progressive meter 160 is viewable through one of the clear portions 147 of the art panel 140. For another example, as best shown in FIG. 6E, a portion of a screen 152 (FIGS. 6B and 6D) of the video display 150 is viewable through one of the clear portions 147 of the art panel 140.

In some alternative implementations of the present disclosure, instead of including clear portions 147 of the art panel 140, the art panel 140 can include one or more apertures (not shown). In such alternative implementations, for example, the progressive meter 160 is positioned such that the major portion of the display of the progressive meter 160 is viewable through the aperture (not shown) of the art panel 140.

As best shown in FIGS. 5B, 5D, 6B, and 6D, the video display 150 is a single video display 150 with the screen 152 and the housing 154. The video display 150 can be any type of video display and can include any number of the same, similar, or different types of video displays, such as, for example, a plasma display, a liquid crystal display, a thin film transistor display, a super liquid crystal display, a light emitting diode display, an organic light emitting diode display, an active matrix organic light emitting diode display, a light emitting diode-backlit liquid crystal display, a retina display, or a laser video display.

The video display 150 is considered a "video" display as opposed to just a source of light or illumination in that the video display 150 is capable of displaying potentially variable content 146 (shown in FIGS. 6B, 6D, and 6E) that is visually readable and/or human readable. By visually readable and/or human readable content it is meant that the content includes, for example, alphanumeric characters displayed by the video display 150, which is readable by a human. For example, the display of "7 7 7" is visually readable by a human as the number seven, followed by the number seven, followed by the number seven. Visually readable and/or human readable content can also be defined based on a combination of a viewing distance and the number of dots or pixels per inch ("DPI") that form the content. For purposes of the present disclosure, visually readable and/or human readable content is content that is meant to be viewed from a distance of around one foot to twenty or more feet and having a resolution of at least 4 DPI×4 DPI—that is, the displayed content includes sixteen dots or pixels per square inch. According to some implementations of the present disclosure, the visually readable and/or human readable content is formed with a resolution of at least 25 DPI×25 DPI. According to some implementations of the present disclosure, the visually readable and/or human readable content is formed with a resolution of at least 100 DPI×100 DPI. According to some implementations, the visually readable and/or human readable content is formed with a resolution greater than 500 DPI×500 DPI.

The video display 150 is capable of displaying a variety of content 146. For example, the video display 150 can display informational content, human readable content, non-informational content, dynamic or animated content, static content, non-informational dynamic or animated content, non-informational static content, etc.

Figure 6D:
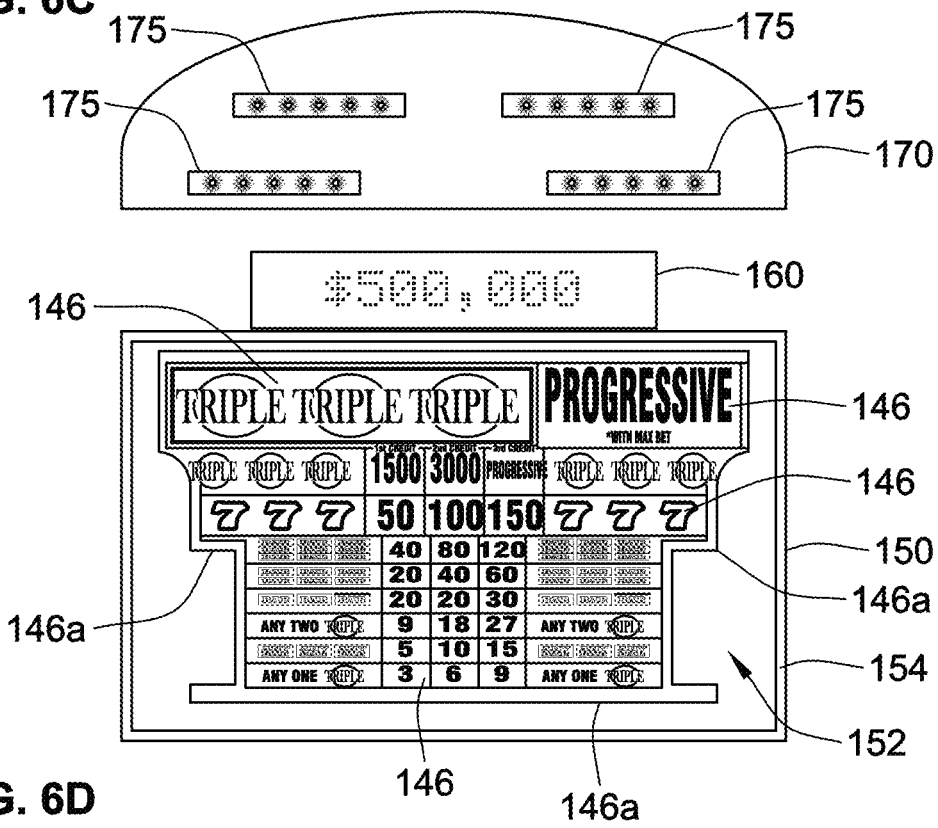
FIG. 6D is a front view of a video display, a progressive meter, and a light panel of the hybrid art-panel-display assembly of FIG. 6A.
Figure 6E:
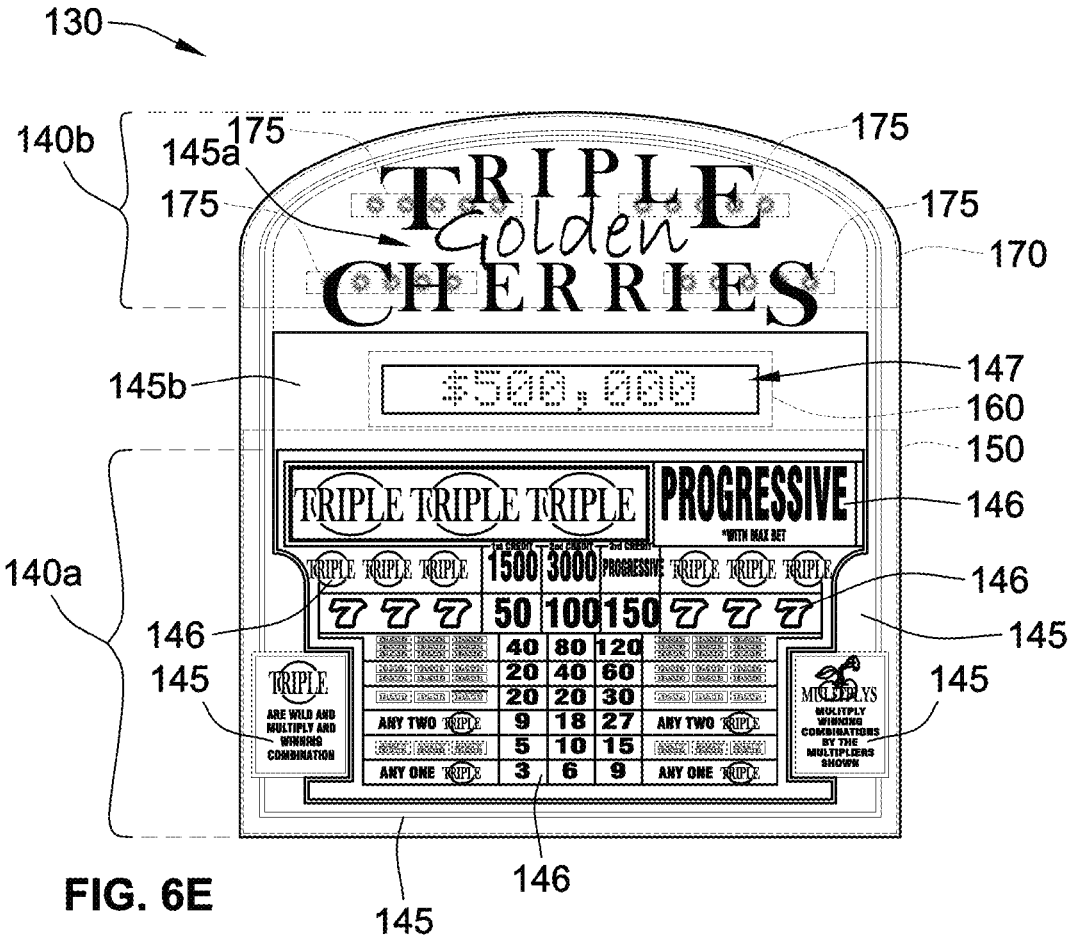
FIG. 6E is an assembled front view of the hybrid art-panel-display assembly of FIG. 6A.

As best shown in FIG. 6D, the video display 150 can display informational content such as a pay table for a slots-type wagering game. The pay table is informational in that it provides a player of the gaming terminal 110 with the payouts for specific winning outcomes of the slots-type wagering game. The pay table is also human readable in that the pay table includes alphanumeric characters. Further, the pay table is also static in that it does not move or appear to have motion with respect to the gaming cabinet 111. Moreover, the pay table can include non-human readable portions and non-informational portions, such as, for example, the borders of the pay table and the dividing lines of the pay table.

In addition to displaying a pay table on the video display 150, other informational content that can be displayed includes, a title of the wagering game being played on the gaming terminal 110, rules associated with playing the wagering game, warnings associated with playing the wagering game, information associated with one or more outcomes of the wagering game, etc. In some implementations of the present disclosure, anything can be displayed on the video display 150, such as, for example, anything that can be displayed on a television and/or a computer monitor. Additional examples of content that can be displayed on the video display 150 is described below and shown in FIGS. 7A-8D.

As best shown in FIGS. 6A and 6E, the art panel 140 and the video display 150 of the hybrid art-panel-display assembly 130 are positioned relative to each other (e.g., when installed in the gaming cabinet 111 shown in FIG. 4) such that the indicia 145 of the art panel 140 and the content 146 displayed on the screen 152 of the video display 150 form an integrated and/or a continuous image viewable to a player of the gaming terminal 110. By "continuous image" it is meant that the indicia 145 and the content 146 both appear to be in a common plane to a player of the gaming terminal 110 playing a wagering game thereon. However, as is apparent from the present disclosure, the indicia 145 and the content 146 are actually in separate and distinct planes.

For example, the indicia 145 are applied to and/or printed on the art panel 140. The indicia 145 can be applied to the front surface 141*a* of the art panel and/or the back surface 141*b* of the art panel 140. Indicia 145 that are applied to and/or printed on the front surface 141*a* of the art panel 140 are in a first plane (e.g., the indicia 145*a*); indicia 145 that are applied to and/or printed on the back surface 141*b* of the art panel 140 are in a second plane (e.g., indicia 145*b*); and content 146 that is displayed on the screen 152 of the video display 150 is in a third plane. The first, the second, and the third planes are all separate and distinct and are not coplanar. In some implementations, the first, the second, and the third planes are parallel or substantially parallel. In some implementations, the first and the second planes are parallel or substantially parallel.

When the hybrid art-panel-display assembly 130 is installed in the gaming cabinet 111, the back surface 141*b* of the art panel 140 is close in proximity to the screen 152 of the video display 150, which aids in providing the continuous image. For example, the back surface 141*b* of the art panel 140 is less than one inch from the screen 152 of the video display 150. In some implementations, the back surface 141*b* of the art panel 140 is less than half an inch from the screen 152 of the video display 150. Further, in some implementations, the back surface 141*b* of the art panel 140 is less than a quarter of an inch from the screen 152 of the video display 150. In some implementations, the back surface 141*b* of the art panel 140 abuts and/or touches the screen 152 of the video display 150, the housing 154 of the video display 150, both, or at least a portion of both.

In some implementations, the indicia 145 of the art panel 140 and the content 146 displayed on the screen 152 of the video display 150 form a continuous image such that a player of the gaming terminal 110 believes that the indicia 145 of the art panel 140 and the content 146 displayed on the screen 152 of the video display 150 are both displayed on a common video display when, in fact, the indicia 145 are not displayed on the video display 150 at all but, rather, are applied to and/or printed on the art panel 140. Further, in such implementations the player of the gaming terminal 110 cannot discern whether the indicia 145 of the art panel 140 and the content 146 displayed on the screen 152 of the video display 150 are both displayed on a common video display when the player is positioned as close as one foot from the art panel 140. That is, a naked human eye cannot readily determine what is applied to and/or printed on the art panel 140 and what is displayed on the screen 152 of the video display 150 when the eye is as close as one foot from the art panel 140.

Similarly, in some implementations, the indicia 145 of the art panel 140 and the content 146 displayed on the screen 152 of the video display 150 form a continuous image such that a player of the gaming terminal 110 believes that the indicia 145 of the art panel 140 and the content 146 displayed on the screen 152 of the video display 150 are both applied to and/or printed on a common art panel when, in fact, the content 146 is not applied to and/or printed on the art panel 140 at all but, rather, is displayed on the screen 152 of the video display 150. Further, in such implementations the player of the gaming terminal 110 cannot discern whether the indicia 145 of the art panel 140 and the content 146 displayed on the screen 152 of the video display 150 are both applied to and/or printed on a common art panel when the player is positioned as close as one foot from the art panel 140. That is, a naked human eye cannot readily determine what is applied to and/or printed on the art panel 140 and what is displayed on the screen 152 of the video display 150 when the eye is as close as one foot from the art panel 140.

The video display 150 is positioned within the second portion 111*b* of the gaming cabinet 111 and adjacent to a portion of the art panel 140 such that at least a first region 140*a* of the art panel 140 overlays the video display 150 and/or is backlit and/or illuminated by the video display 150. As best shown in FIGS. 6A and 6E, the art panel 140 and the video display 150 of the hybrid art-panel-display assembly 130 are positioned relative to each other (e.g., when installed in the gaming cabinet 111 shown in FIG. 4) such that the video display 150 backlights and/or illuminates a portion (e.g., the first region 140*a*, best shown in FIGS. 5B and 6B) of the art panel 140. That is, as the video display 150 displays content (e.g., content 146), the video display 150 emits light that is transmitted from the screen 152 of the video display 150 onto the back surface 141*b* of the art panel 140. Some of the light transmitted onto the back surface 141*b* of the art panel 140 from the video display 150 may reflect off the back surface 141*b*, some of the light transmitted onto the back surface 141*b* of the art panel 140 from the video display 150 may absorb into the art panel 140, and some of the light the light transmitted onto the back surface 141*b* of the art panel 140 from the video display 150 may be transmitted through the art panel 140 and out of the front surface 141*a* of the art panel 140, thereby backlighting and/or illuminating at least a portion (e.g., 99%, 90%, 75%, 50%, etc.) of the first region 140*a* of the art panel 140.

Of course, in addition to, or in lieu of, displaying the exemplary detailed and/or extensive content 145 that emits light that is used to backlight the first region 140*a* of the art panel 140, the video display 150 can display blank areas of, for example, white light, green light, blue light, yellow light, etc., which causes the screen 152 to emit such color of light that backlights the art panel 140. The blank areas of, for example, white light can be displayed by the video display 150, for example, behind the indicia 145. Thus, in some implementations, the video display 150 displays content 145 (e.g., a pay table) in areas where no indicia 145 are located directly in front of the screen 152 and the video display 150 displays blank areas of, for example, white light in areas where indicia 145 are located directly in front of the screen 152. The blank areas of light and the displayed content 146 can overlap and/or be offset from the indicia 145 to aid in providing a continuous image. For example, the displayed border content 146*a* (FIG. 6D) can be displayed at least partially behind some of the border indicia 145*c* (FIG. 6C).

Using the video display 150 to backlight at least a portion of the first region 140*a* of the art panel 140 brightens the indicia 145 applied to and/or printed on the first region 140*a* of the art panel 140. That is, in addition to external light (e.g., lights in a ceiling above the gaming terminal 110) lighting up the indicia 145, for example, using reflection, the light emitted by the video display 150 further lights up (i.e., illuminates and/or backlights) the indicia 145 using transmission, absorption, reflection, or any combination thereof. The use of the video display 150 to backlight the first region 140*a* of the art panel 140 is separate and distinct from the use of light sources that are not capable of displaying video, such as, for example, the light panel 170.

The light panel 170 is positioned within the second portion 111*b* of the gaming cabinet 111 and adjacent to a portion of the art panel 140 such that at least a second region 140*b* of the art panel 140 overlays the light panel 170 and/or is backlit and/or illuminated by the light panel 170. As best shown in FIGS. 5B and 6B, the light panel 170 includes a multitude of illumination devices 175. Each one of the illumination devices 175 can include one or more light emitting diodes, one or more incandescent light bulbs, one or more halogen light bulbs, one or more fluorescent light bulbs, one or more high-intensity discharge light bulbs, or any combination thereof. As shown, each illumination device includes five LEDs attached to a circuit board, however, any number of LEDs can be used. Each of the illumination devices 175 can emit the same color of light (e.g., all emit white light, blue light, green light, yellow light, etc.) or a variety of colors of light (e.g., some of the illumination devices 175 emit white light, some of the illumination devices 175 emit blue light, etc.). Further, in some implementations, an illumination device 175 can be setup to emit a variety of different colors of light itself (e.g., an illumination device 175 can include a multitude of different colored LEDs).

The light panel 170 and/or the illumination devices 175 are separate and distinct from the video display 150. Further the light panel 170 and/or the illumination devices 175 are different than the video display 150 at least in that the light panel 170 and/or the illumination devices 175 do not, and cannot, directly display human readable content. That is, the light panel 170 and/or the illumination devices 175 are not video displays. Further, the light panel 170 and/or the illumination devices 175 are not capable of displaying information associated with the wagering game conducted on the gaming terminal 110.

As best shown in FIG. 6A, the art panel 140 and the light panel 170 of the hybrid art-panel-display assembly 130 are positioned relative to each other (e.g., when installed in the gaming cabinet 111 shown in FIG. 4) such that the illumination devices 175 of the light panel 170 backlight and/or illuminate a portion (e.g., a second region 140*b*, best shown in FIGS. 5B and 6B) of the art panel 140. That is, the illumination devices 175 emit light that is transmitted onto the back surface 141*b* of the art panel 140. Some of the light transmitted onto the back surface 141*b* of the art panel 140 from the illumination devices 175 may reflect off the back surface 141*b*, some of the light transmitted onto the back surface 141*b* of the art panel 140 from the illumination devices 175 may absorb into the art panel 140, and some of the light the light transmitted onto the back surface 141*b* of the art panel 140 from the illumination devices 175 may be transmitted through the art panel 140 and out of the front surface 141*a* of the art panel 140, thereby backlighting and/or illuminating at least a portion (e.g., 99%, 90%, 75%, 50%, etc.) of the second region 140*b* of the art panel 140.

Using the light panel 170 to backlight at least a portion of the second region 140*b* of the art panel 140 brightens the indicia 145 applied to and/or printed on the second region 140*b* of the art panel 140. That is, in addition to external light (e.g., lights in a ceiling above the gaming terminal 110) lighting up the indicia 145, for example, using reflection, the light emitted by the light panel 170 further lights up (i.e., illuminates and/or backlights) the indicia 145 using transmission, absorption, reflection, or any combination thereof. The use of the light panel 170 to backlight the second region 140*b* of the art panel 140 is separate and distinct from the use of the video display 150.

The progressive meter 160 is positioned within the second portion 111*b* of the gaming cabinet 111 and adjacent to the art panel 140 such that a major portion of a display of the progressive meter 160 is viewable through at least a portion of the art panel 140. As best shown in FIGS. 5A and 6A, a major portion (e.g., 100%, 99%, 90%, 75%, etc.) of a display of the progressive meter 160 is viewable through one of the clear portions 147 of the art panel 140. The display of the progressive meter 160 displays human readable content (e.g., numbers, commas, dollar signs—$—, etc.) associated with a progressive award. As shown, the progressive meter in FIG. 6E displays a potential progressive award of $500,000. The award may constantly change based on the outcomes of various associated wagering games.

The display of the progressive meter 160 includes a multitude of light pixels or light dots, such as, for example, light emitting diodes. It is the multitude of light pixels that permits the progressive display to display human readable content. The number of light pixels can be increased or decreased to change the resolution of the progressive meter 160. However, the resolution must be sufficient such that the progressive meter 160 can display human readable content. In some implementations, the resolution of the progressive meter 160 is no more than two hundred pixels (e.g., light pixels) by two hundred pixels (e.g., light pixels) per square inch (e.g., a total of 40,000 light pixels per square inch of the display of the progressive meter 160). In some implementations, the resolution of the progressive meter 160 is at least five pixels (e.g., light pixels) by five pixels (e.g., light pixels) per square inch (e.g., a total of 25 light pixels per square inch of the display of the progressive meter 160).

The progressive meter 160 is separate and distinct from the video display 150. Further the progressive display 160 is different than the video display 150 at least in that the progressive display 160 has a relatively lower resolution. For example, in some implementations of the present disclosure, the resolution of the progressive meter 160 is no more than two hundred pixels by two hundred pixels per square inch and the video display 150 has a resolution of at least five hundred pixels by five hundred pixels per square inch. For another example, in some implementations of the present disclosure, the resolution of the video display 150 is at least three times greater than the resolution of the progressive meter 160. For yet another example, in some implementations of the present disclosure, the resolution of the video display 150 is at least five times greater than the resolution of the progressive meter 160. For yet a further example, in some implementations of the present disclosure, the resolution of the video display 150 is at least ten times greater than the resolution of the progressive meter 160. For another example, in some implementations of the present disclosure, the resolution of the video display 150 is at least one hundred times greater than the resolution of the progressive meter 160.

The progressive meter 160 is also separate and distinct from the light panel 170. Further the progressive meter 160 is different than the light panel 170 at least in that the light panel 170 and/or the illumination devices 175 do not, and cannot, directly display human readable content. That is, the light panel 170 is not a meter capable of displaying human readable content (e.g., a potential progressive award). Further, the illumination devices 175 are not capable of displaying information associated with the wagering game conducted on the gaming terminal 110.

Referring to FIGS. 7A-7D, an alternative implementation of the hybrid art-panel-display assembly 130 of the gaming terminal 110 is shown, where like reference numbers are used for like components. The hybrid art-panel-display assembly 130 of FIGS. 7A-7D is the same as the hybrid art-panel-display assembly 130 of FIGS. 6A-6E; however, the indicia 145 and the content 146 are different. Specifically, the indicia 145 and the content 146 of FIGS. 7A-7D are related to a dice themed wagering game.

Figure 7A:
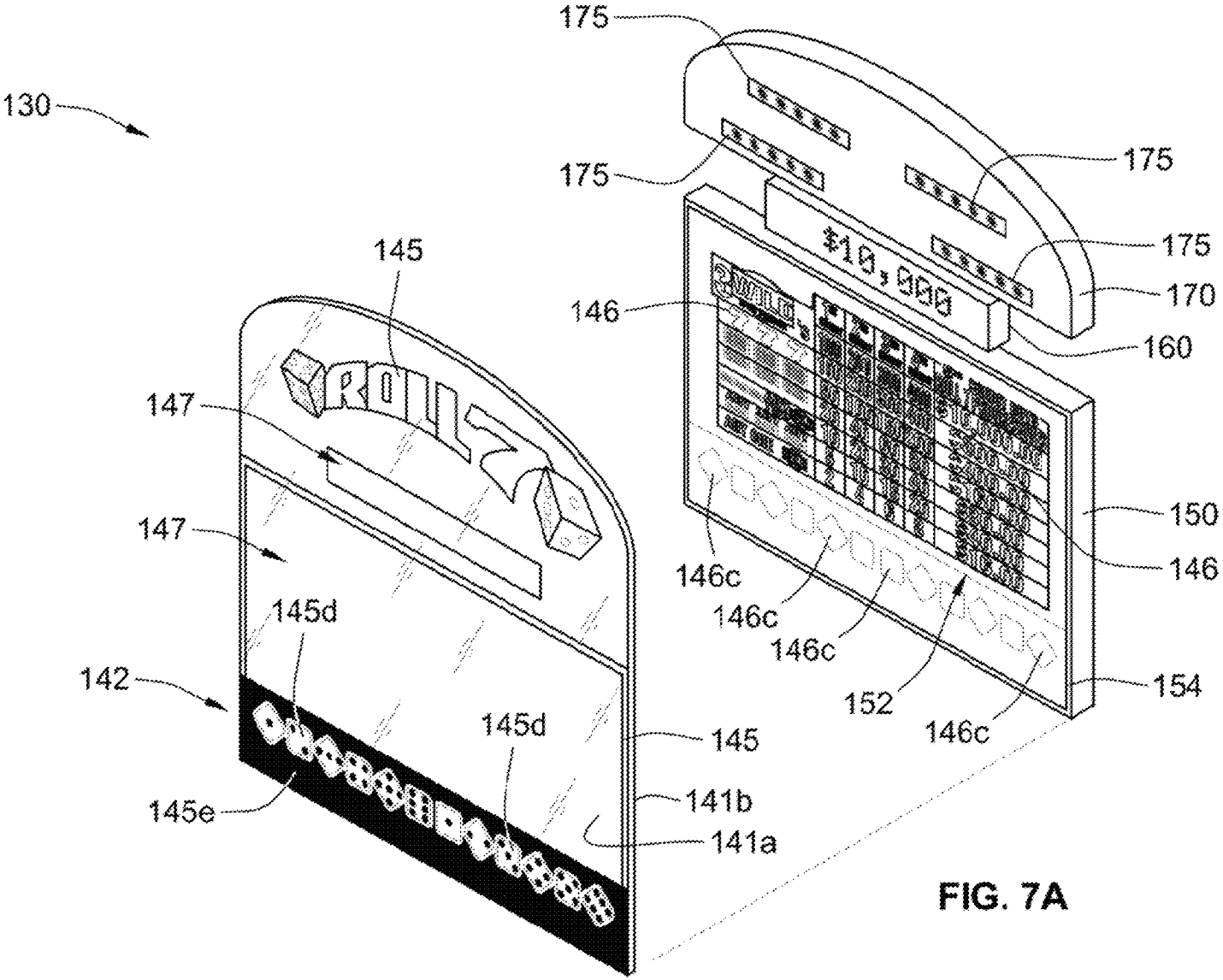
FIG. 7A is an exploded perspective view of a hybrid art-panel-display assembly of a gaming terminal similar to the gaming terminal of FIG. 4 according to some aspects of the present disclosure.
Figure 7B:
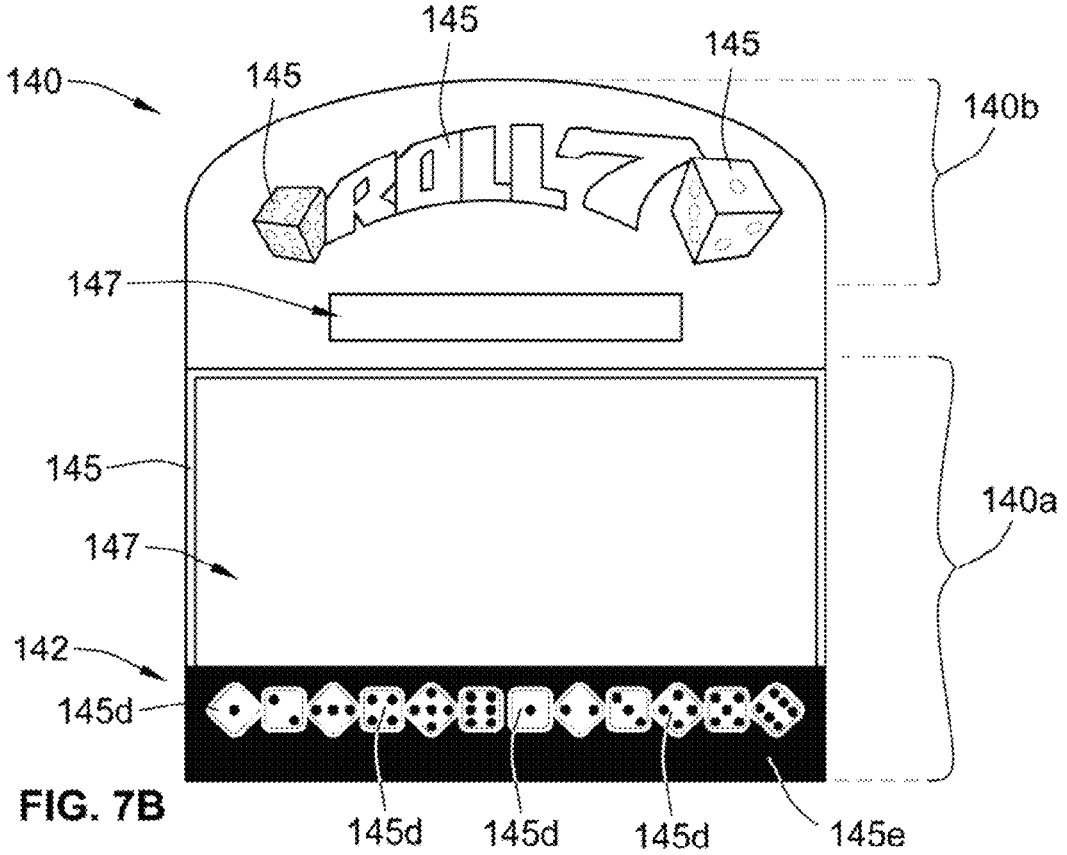
FIG. 7B is a front view of an art panel of the hybrid art-panel-display assembly of FIG. 7A.

As best shown in FIGS. 7A and 7B, a bottom portion 142 of the art panel 140 includes twelve dice indicia 145*d*. Specifically, six faces of each of a pair of dice are represented using twelve dice indicia 145*d* positioned in a line along the bottom portion 142 of the art panel 140. The "dots" of the dice (e.g., the portion on the face of a die used to indicate the number rolled) are substantially opaque portions of the dice indicia 145*d*, as indicated using solid black for the dots in the figures. A generally square area around the dots for each of the dice indicia 145*d* is substantially transparent (e.g., like a clear glass or plastic window), as indicated as using solid white in the figures. The area surrounding the dice indicia 145*d* is a substantially opaque indicia 145*e*, as indicated using solid black, best seen in FIG. 7B. As such, when viewing the front surface 141*a* of the art panel 140 with a light source behind the art panel 140, each of the twelve dice indicia 145 are readily viewable. The substantially opaque indicia 145*e* can be any color, such as, for example, black, blue, dark blue, dark purple, dark green, etc.

Figure 7C:
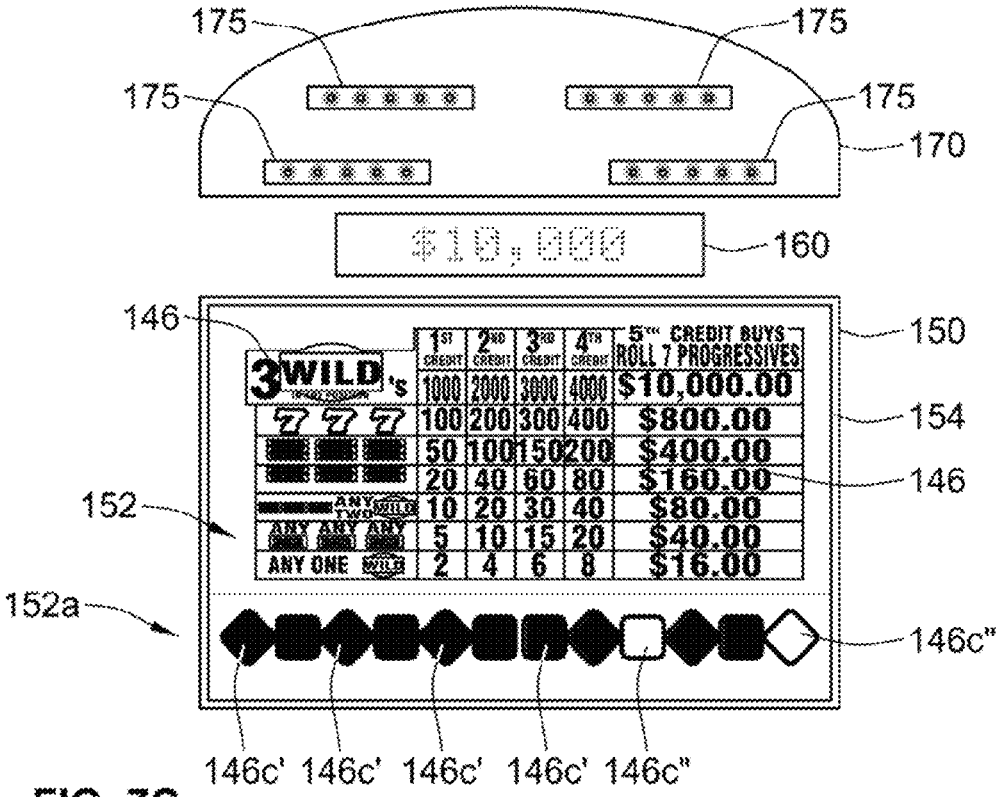
FIG. 7C is a front view of a video display, a progressive meter, and a light panel of the hybrid art-panel-display assembly of FIG. 7A.

In the same, or similar, manner discussed above, the art panel 140 is positioned adjacent to the video display 150 in the second portion 111*b* of the gaming cabinet 111. As best shown in FIGS. 7A and 7C, the video display 150 is able to selectively display squares or shapes of colored content 146*c* (e.g., a white square, a black square, a green square, a red square, a white diamond, a blue rectangle, etc.) in positions corresponding to the dice indicia 145*d* on the art panel 140. The displayed colored content 146*c* can be any color, such as, for example, black, blue, dark blue, dark purple, dark green, etc. The color of the displayed colored content 146*c* can be the same as, substantially the same as, or similar to, the color of the substantially opaque indicia 145*e*. As such, the video display 150 is able to selectively highlight and/or illuminate one or more of the dice indicia 145*d* or selectively conceal one or more of the dice indicia 145*d*. Specifically, the video display 150 is able to conceal dice indicia 145*d* by, for example, blacking out a portion of the display 152 of the display device 150 corresponding to such dice indicia 145*d*. By "blacking out" it is meant that the video display 150 turns, for example, black in an area by either displaying black and/or dark colored content (e.g., the colored content 146*c*, a black square, a dark purple square, etc.) or by not using or not turning on any of its pixels in that area. For example, when a computer monitor is turned off, all of the pixels of that computer monitor are blacked out. For another example, when watching content having a 4:3 aspect ratio on a wide screen television (i.e., a television with a 16:9 aspect ratio), the typical black bars on the sides of the picture are blacked out pixels of the television. For another example, when the substantially opaque indicia 145*e* is dark blue, the colored content 146*c* can also be dark blue to "black out" some or all of the dice indicia 145*d*

Figure 7D:
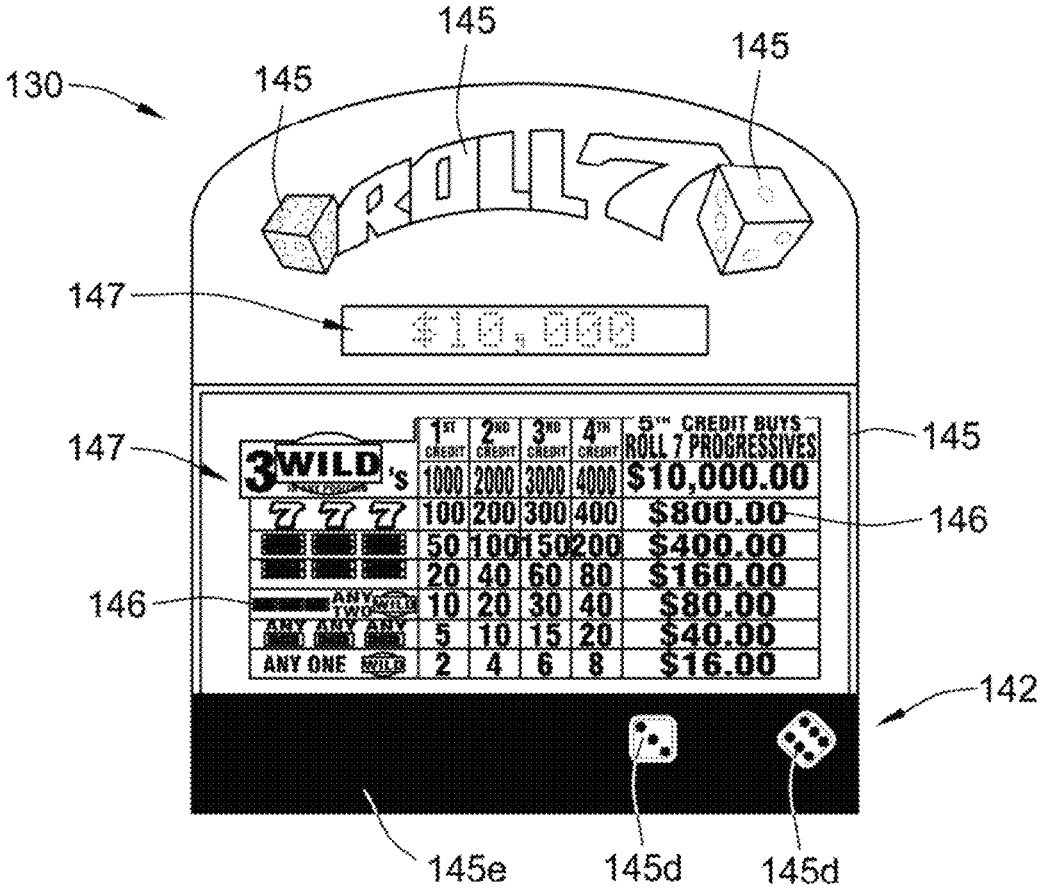
FIG. 7D is an assembled front view of the hybrid art-panel-display assembly of FIG. 7A indicating a first roll of dice.

As shown in FIG. 7C, a bottom portion 152*a* of the screen 152 of the video display 150 is displaying ten squares of black colored content 146*c*' in areas that correspond with ten of the dice indicia 145*d* of the art panel 140. The video display 150 is also displaying two squares of white colored content 146" in areas that correspond with two of the dice indicia 145*d*. As such, ten of the dice indicia 145*d* are blacked out and are substantially not viewable to a player of the wagering game (e.g., the ten dice indicia 145*d* corresponding to the black colored content 146*c*' are concealed from the player). However, the two dice indicia 145*d* corresponding to the two squares of white colored content 146*c*" are viewable to the player. Specifically, as best shown in FIG. 7D, all of the dice indicia 145*d* are blacked out except for a three and a six dice indicia 145*d* for a total roll of nine, which can impact the wagering game. Thus, in addition to the video display 150 being used to backlight the art panel 150 as described above, the video display 150 can be used to selectively conceal a portion of the indicia 145 applied to and/or printed on the art panel 140.

Referring to FIGS. 8A-8D, an alternative implementation of the hybrid art-panel-display assembly 130 of the gaming terminal 110 is shown, where like reference numbers are used for like components. The hybrid art-panel-display assembly 130 of FIGS. 8A-8D is the same as the hybrid art-panel-display assembly 130 of FIGS. 6A-6E; however, the indicia 145 and the content 146 are different. Specifically, the indicia 145 and the content 146 of FIGS. 8A-8D are related to a fishing themed wagering game.

The art panel 140 includes grass indicia 145*g* and the video display 150 is displaying dynamic and/or animated grass content 146*g*. The dynamic grass content 146*g* is displayed on a portion of the screen 152 such that the dynamic grass content 146*g* visually interacts with the grass indicia 145*g* on the art panel 140. The grass indicia 145*g* can be opaque, transparent, or a combination thereof to aid in providing an integrated and/or continuous image between the indicia 145 on the art panel 140 and the content 146 displayed by the video display 150. In some implementations, the color of the indicia 145 (e.g., the grass indicia 145*g*) on the art panel 140 is a first color and the color of the displayed content 146 (e.g., the dynamic grass content 146*g*) is a second color. The first and the second colors can be the same or different. Further, the first and the second colors can be different shades of a third color. For example, the color of the grass indicia 145*g* can be light green and the color of the grass content 146*g* can be dark green.

Of course, the grass indicia 145*g* and the dynamic grass content 146*g* are exemplary and can be rearranged, supplemented, and/or replaced with any other combination of indicia and content (dynamic, static, or a combination of both) for any number of other wagering games. For example, a title indicium (e.g., "AFTERSHOCK") can be applied to and/or printed on an art panel for a gaming terminal setup to conduct the titled game. The title indicia can be partially opaque and partially transparent. For example, a line of transparency can run in a jagged line through the title indicia from left to right. Dynamic content (e.g., a white shape) can be displayed on the display device behind the title indicia such that the content provides a dynamic appearance to the transparent portion of the title indicia. Specifically, the display device can display black and/or blackout the title indicia and then display moving white content (e.g., an expanding white rectangle) in an area that corresponds with the line of transparency of the title indicia.

Figure 8A:
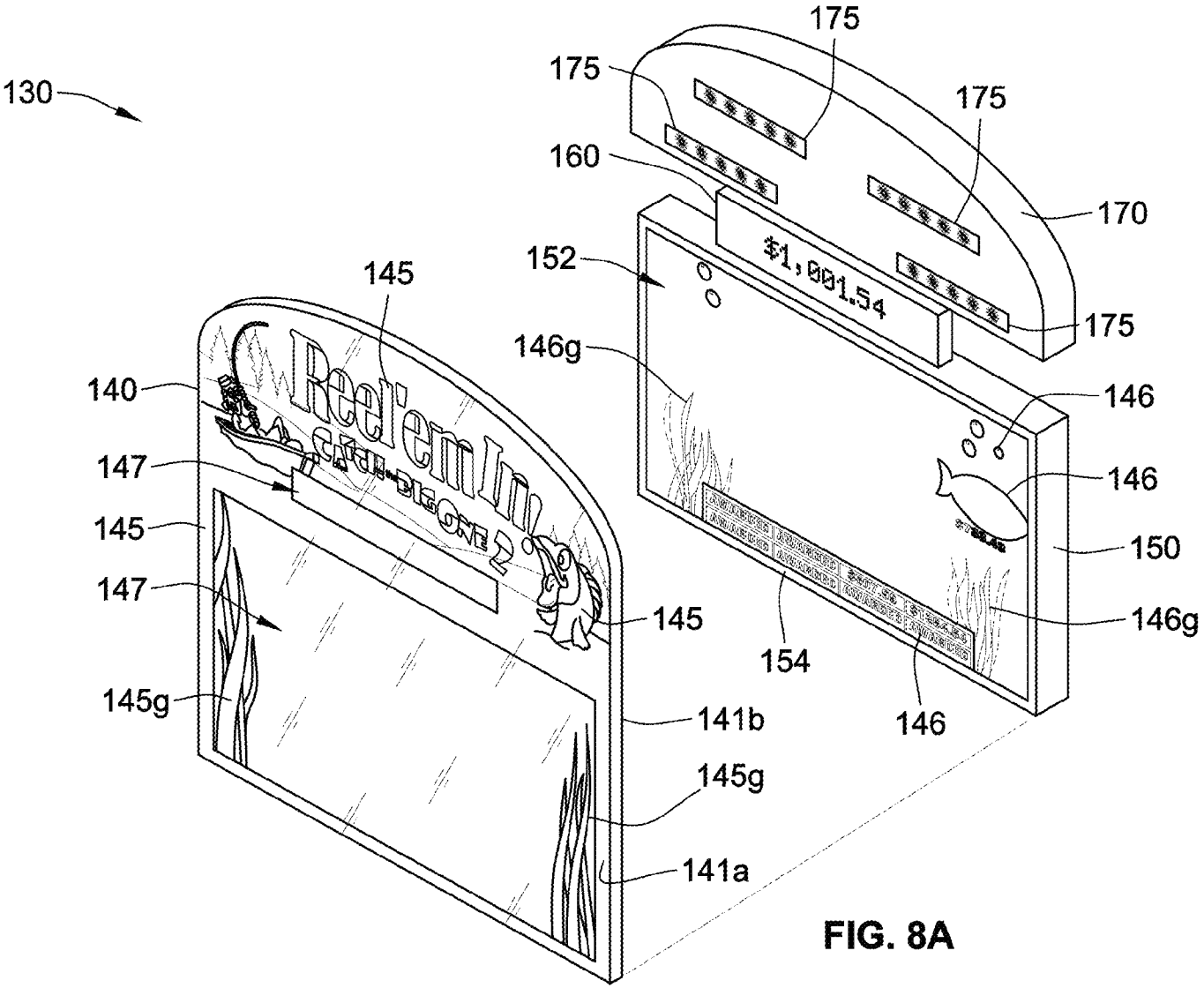
FIG. 8A is an exploded perspective view of a hybrid art-panel-display assembly of a gaming terminal similar to the gaming terminal of FIG. 4 according to some aspects of the present disclosure.
Figure 8B:
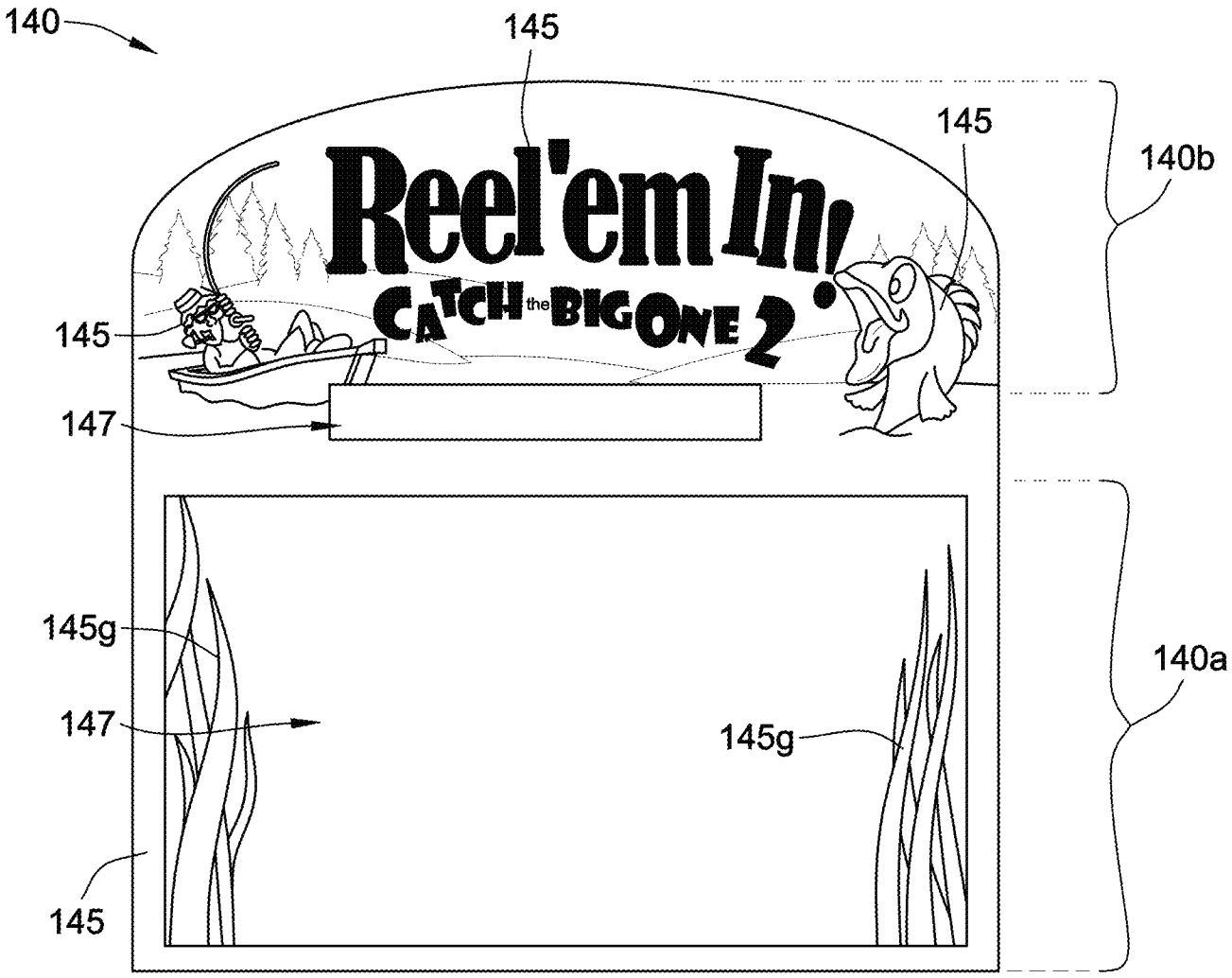
FIG. 8B is a front view of an art panel of the hybrid art-panel-display assembly of FIG. 8A.
Figure 8C:
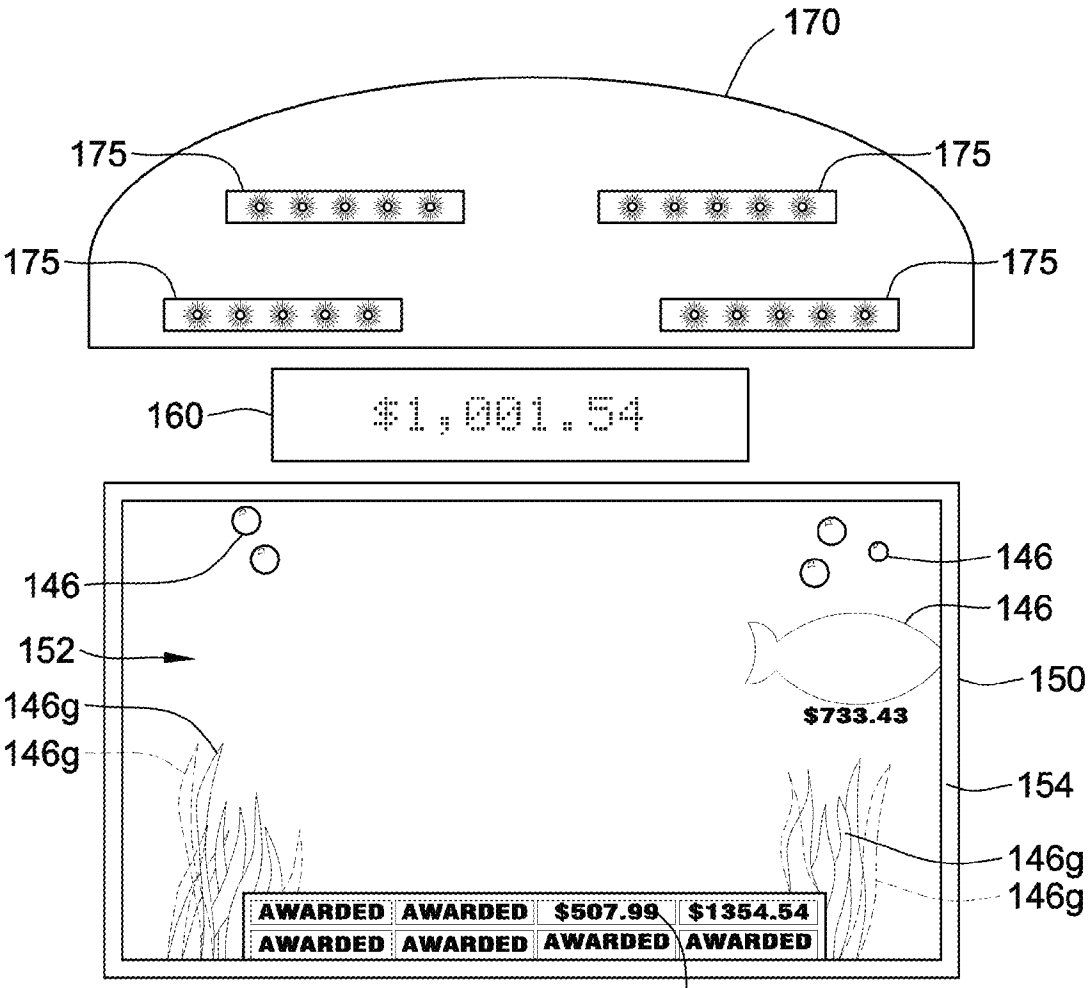
FIG. 8C is a front view of a video display, a progressive meter, and a light panel of the hybrid art-panel-display assembly of FIG. 8A.
Figure 8D:
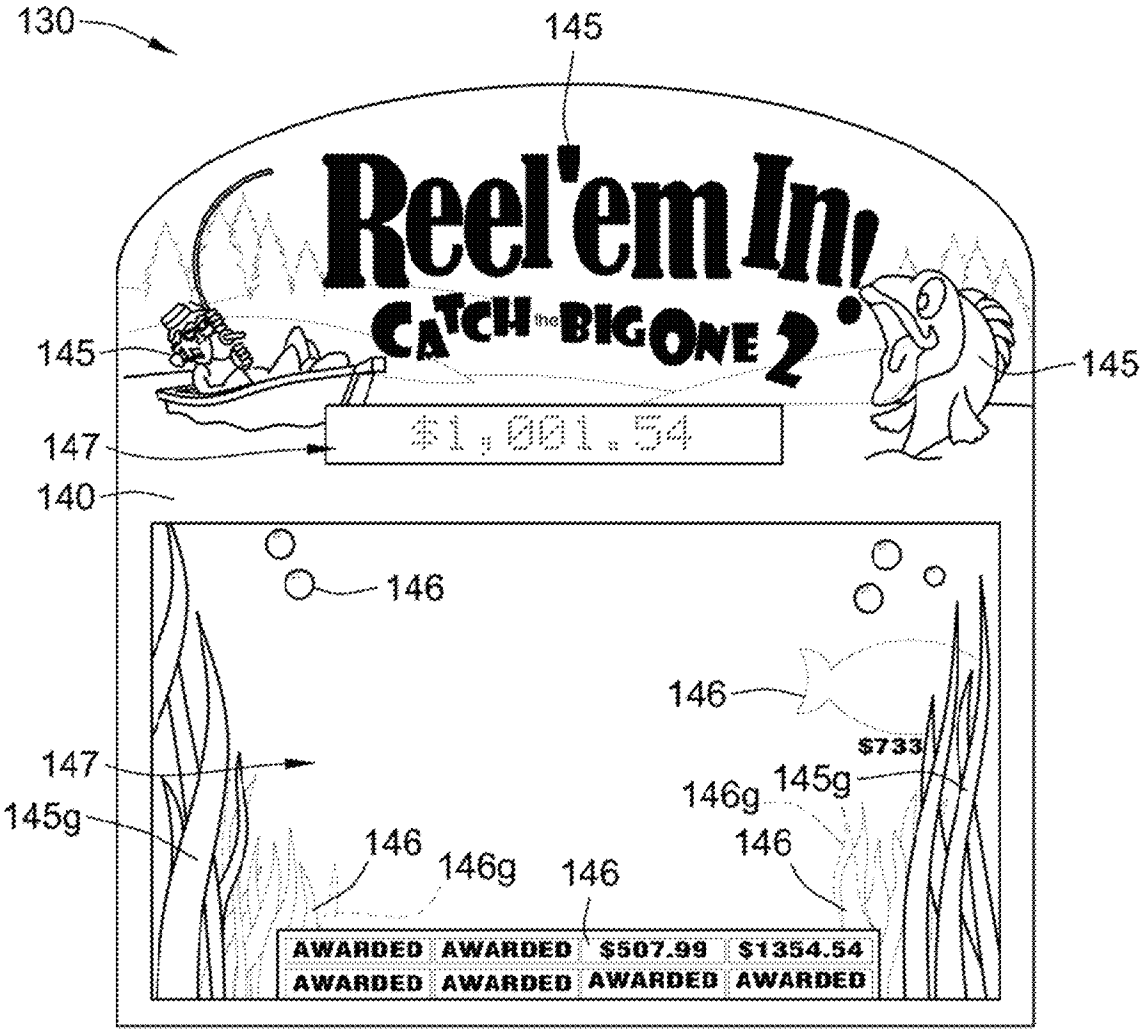
FIG. 8D is an assembled front view of the hybrid art-panel-display assembly of FIG. 8A.

Similar to the implementation described with respect to FIGS. 7A-7D, the grass indicia 145*g* of FIGS. 8A, 8B, and 8D can be selectively concealed by displaying colored content (e.g., a green rectangle) of the same color as the grass indicia 145*g* on the video display 150 behind the grass indicia 145*g*. Alternatively, the grass indicia 145*g* can be highlighted and/or illuminated/backlit by displaying colored content behind the grass indicia 145*g*, such as, for example, blue water content, blank white content, etc.

Alternative Implementations

Alternative Implementation 1. A gaming terminal for conducting a wagering game, the gaming terminal comprising: a gaming cabinet including a first portion and a second portion positioned above the first portion of the gaming cabinet; one or more symbol bearing reels positioned within the first portion of the gaming cabinet, the one or more symbol bearing reels being configured to indicate randomly selected outcomes for the wagering game; a video display positioned within the second portion of the gaming cabinet and being configured to display content associated with the wagering game; and an art panel positioned within the second portion of the gaming cabinet and overlaying the video display such that at least a first region of the art panel is backlit by the video display.

Alternative Implementation 2. The gaming terminal of alternative implementation 1, wherein the art panel includes one or more indicia.

Alternative Implementation 3. The gaming terminal of alternative implementation 2, wherein at least a portion of one of the one or more indicia is at least partially transparent such that at least some light emitted from the video display is viewable to a player of the gaming terminal.

Alternative Implementation 4. The gaming terminal of alternative implementation 1, wherein at least a portion of the content displayed by the video display is informational content.

Alternative Implementation 5. The gaming terminal of alternative implementation 1, wherein at least a portion of the content displayed by the video display is human readable content.

Alternative Implementation 6. The gaming terminal of alternative implementation 2, wherein at least one of the one or more indicia and at least a portion of the content displayed by the video display form a continuous image viewable to a player of the gaming terminal.

Alternative Implementation 7. The gaming terminal of alternative implementation 2, wherein at least a portion of the content displayed by the video display is dynamic content that visually interacts with at least one of the one or more indicia.

Alternative Implementation 8. The gaming terminal of alternative implementation 7, wherein the dynamic content includes a first color and the at least one of the one or more indicia that visually interacts with the dynamic content includes a second color.

Alternative Implementation 9. The gaming terminal of alternative implementation 8, wherein the first color and the second color are the same.

Alternative Implementation 10. The gaming terminal of alternative implementation 8, wherein the first color and the second color are different shades of a third color.

Alternative Implementation 11. The gaming terminal of alternative implementation 2, wherein at least a portion of the content displayed by the video display is non-informational dynamic content that visually interacts with at least one of the one or more indicia that is non-informational.

Alternative Implementation 12. The gaming terminal of alternative implementation 2, wherein the video display is configured to selectively conceal at least one of the one or more indicia by blacking out a portion of the video display.

Alternative Implementation 13. The gaming terminal of alternative implementation 2, wherein the one or more indicia are printed on a front surface of the art panel, a back surface of the art panel, or both.

Alternative Implementation 14. The gaming terminal of alternative implementation 2, wherein at least one of the one or more indicia includes a mirrored surface.

Alternative Implementation 15. The gaming terminal of alternative implementation 2, wherein at least one of the one or more indicia includes an etched surface.

Alternative Implementation 16. The gaming terminal of alternative implementation 2, wherein the one or more indicia are positioned on the art panel such that at least a portion of the one or more indicia mask less aesthetically pleasing areas behind the art panel.

Alternative Implementation 17. The gaming terminal of alternative implementation 2, wherein at least one of the one or more indicia is associated with a theme of the wagering game.

Alternative Implementation 18. The gaming terminal of alternative implementation 2, wherein at least a portion of one of the one or more indicia is opaque.

Alternative Implementation 19. The gaming terminal of alternative implementation 1, further comprising a progressive meter positioned within the second portion of the gaming cabinet and adjacent to the art panel such that a major portion of a display of the progressive meter is viewable through at least a portion of the art panel.

Alternative Implementation 20. The gaming terminal of alternative implementation 19, wherein the display of the progressive meter includes a plurality of light emitting diodes.

Alternative Implementation 21. The gaming terminal of alternative implementation 20, wherein the display of the progressive meter is configured to directly display human readable content.

Alternative Implementation 22. The gaming terminal of alternative implementation 19, wherein the video display is separate and distinct from and different than the progressive meter.

Alternative Implementation 23. The gaming terminal of alternative implementation 22, wherein the display of the progressive meter has a resolution of no more than ten pixels by ten pixels per square inch and wherein the video display has a resolution of at least five hundred pixels by five hundred pixels per square inch.

Alternative Implementation 24. The gaming terminal of alternative implementation 22, wherein the resolution of the video display is at least three times greater than the resolution of the progressive meter.

Alternative Implementation 25. The gaming terminal of alternative implementation 19, wherein at least a portion of one of the one or more indicia is at least partially transparent and wherein the progressive meter is positioned such that the major portion of the display of the progressive meter is viewable through the at least a portion of the one of the one or more indicia that is at least partially transparent.

Alternative Implementation 26. The gaming terminal of alternative implementation 19, wherein the art panel includes an aperture and wherein the progressive meter is positioned such that the major portion of the display of the progressive meter is viewable through the aperture of the art panel.

Alternative Implementation 27. The gaming terminal of alternative implementation 19, wherein the art panel includes a clear portion and wherein the progressive meter is positioned such that the major portion of the display of the progressive meter is viewable through the clear portion of the art panel.

Alternative Implementation 28. The gaming terminal of alternative implementation 1, further comprising one or more illumination devices positioned within the second portion of the gaming cabinet and adjacent to the art panel such that at least a second region of the art panel is backlit by the one or more illumination devices.

Alternative Implementation 29. The gaming terminal of alternative implementation 28, wherein the one or more illumination devices include one or more light emitting diodes, one or more incandescent light bulbs, one or more halogen light bulbs, one or more fluorescent light bulbs, one or more high-intensity discharge light bulbs, or any combination thereof.

Alternative Implementation 30. The gaming terminal of alternative implementation 28, wherein the one or more illumination devices are configured such that the one or more illumination devices do not directly display human readable content.

Alternative Implementation 31. The gaming terminal of alternative implementation 28, wherein the video display is separate and distinct from and different than the one or more illumination devices.

Alternative Implementation 32. The gaming terminal of alternative implementation 1, wherein the video display includes one or more plasma displays, one or more liquid crystal displays, one or more thin film transistor displays, one or more super liquid crystal displays, one or more light emitting diode displays, one or more organic light emitting diode displays, one or more active matrix organic light emitting diode displays, one or more light emitting diode-backlit liquid crystal displays, one or more retina displays, one or more laser video displays, or any combination thereof.

Alternative Implementation 33. The gaming terminal of alternative implementation 1, wherein the one or more symbol bearing reels are mechanical reels.

Alternative Implementation 34. The gaming terminal of alternative implementation 1, wherein the one or more symbol bearing reels are simulated reels displayed on a portion of a second video display positioned within the first portion of the gaming cabinet.

Alternative Implementation 35. The gaming terminal of alternative implementation 1, wherein the art panel includes one or more glass panels, one or more plastic panels, or a combination thereof.

Alternative Implementation 36. A gaming terminal for conducting a wagering game, the gaming terminal comprising: a gaming cabinet including a first portion and a second portion positioned above the first portion of the gaming cabinet; one or more symbol bearing reels positioned within the first portion of the gaming cabinet, the one or more symbol bearing reels being configured to indicate randomly selected outcomes for the wagering game; a video display positioned within the second portion of the gaming cabinet and being configured to display content associated with the wagering game; one or more illumination devices positioned within the second portion of the gaming cabinet and being configured to emit light; and an art panel positioned within the second portion of the gaming cabinet and overlaying the video display and the one or more illumination devices such that a first region of the art panel is illuminated by the video display and a second region of the art panel is illuminated by the one or more illumination devices.

Alternative Implementation 37. The gaming terminal of alternative implementation 36, wherein the art panel includes one or more indicia.

Alternative Implementation 38. The gaming terminal of alternative implementation 37, wherein the one or more indicia include a mirrored surface, an etched surface, or both.

Alternative Implementation 39. The gaming terminal of alternative implementation 37, wherein the one or more indicia are positioned on the art panel such that at least a portion of the one or more indicia mask a portion of a housing of the video display.

Alternative Implementation 40. The gaming terminal of alternative implementation 36, further comprising a progressive meter positioned within the second portion of the gaming cabinet and adjacent to the art panel such that a major portion of a display of the progressive meter is viewable through at least a portion of the art panel.

Alternative Implementation 41. The gaming terminal of alternative implementation 40, wherein the video display is separate and distinct from and different than the progressive meter and wherein the video display is separate and distinct from and different than the one or more illumination devices and wherein the progressive meter is separate and distinct from and different than the one or more illumination devices.

Alternative Implementation 42. The gaming terminal of alternative implementation 41, wherein the resolution of the video display is at least five times greater than the resolution of the progressive meter.

Alternative Implementation 43. The gaming terminal of alternative implementation 36, wherein the one or more symbol bearing reels are mechanical reels.

Alternative Implementation 44. The gaming terminal of alternative implementation 36, wherein at least a portion of the content displayed by the video display is human readable content, and wherein the one or more illumination devices are configured such that the one or more illumination devices do not directly display human readable content.

Alternative Implementation 45. A gaming terminal for conducting a wagering game, the gaming terminal comprising: a gaming cabinet; a video display positioned within the gaming cabinet and being configured to display content associated with the wagering game; and an art panel positioned within the gaming cabinet and overlaying the video display such that a first region of the art panel is illuminated by the video display.

Alternative Implementation 46. The gaming terminal of alternative implementation 45, further comprising one or more mechanical symbol bearing reels positioned within the gaming cabinet and being configured to indicate randomly selected outcomes for the wagering game.

Alternative Implementation 47. The gaming terminal of alternative implementation 46, further comprising one or more illumination devices positioned within the gaming cabinet and adjacent to the art panel such that a second region of the art panel is illuminated using the one or more illumination devices.

Alternative Implementation 48. The gaming terminal of alternative implementation 47, wherein the video display is separate and distinct from the one or more illumination devices.

Alternative Implementation 49. The gaming terminal of alternative implementation 48, wherein at least a portion of the content displayed by the video display is human readable content associated with the wagering game, and wherein the one or more illumination devices are configured such that the one or more illumination devices do not directly display human readable content.

Alternative Implementation 50. The gaming terminal of alternative implementation 48, wherein the one or more illumination devices are not capable of displaying information associated with the wagering game.

Alternative Implementation 51. The gaming terminal of alternative implementation 47, further comprising a progressive meter positioned within the gaming cabinet and adjacent to the art panel such that a display of the progressive meter is viewable through at least a portion of the art panel.

Alternative Implementation 52. The gaming terminal of alternative implementation 51, wherein the resolution of the video display is at least ten times greater than the resolution of the progressive meter.

It is contemplated that any element or elements from any one of the above implementations (i.e., implementations 1-52) can be combined with any other element or elements from any of the other ones of the above implementations (i.e., implementations 1-52).

Each of the above concepts and obvious variations thereof is contemplated as falling within the spirit and scope of the claimed invention, which is set forth in the following claims.

What is claimed is:

1. A gaming terminal for conducting a wagering game, the gaming terminal comprising:

a gaming cabinet including a first portion and a second portion positioned above the first portion of the gaming cabinet;

one or more symbol bearing reels positioned within the first portion of the gaming cabinet, the one or more symbol bearing reels being configured to indicate randomly selected outcomes for the wagering game;

a video display positioned within the second portion of the gaming cabinet and being configured to display pay indicia associated with the wagering game; and an art panel including a demarcated clear portion through which the pay indicia is viewable, the art panel further including one or more printed indicia, the art panel being positioned within the second portion of the gaming cabinet and overlaying the video display such that (i) at least a first region of the art panel is backlit by the video display and (ii) the video display is configured to selectively conceal at least one of the one or more printed indicia.

2. The gaming terminal of claim 1, wherein at least one of the one or more printed indicia and at least a portion of the pay indicia displayed by the video display form a continuous image viewable to a player of the gaming terminal.

3. The gaming terminal of claim 1, wherein the video display is configured to selectively conceal the least one of the one or more printed indicia by blacking out a portion of the video display.

4. The gaming terminal of claim 1, further comprising a progressive meter positioned within the second portion of the gaming cabinet and adjacent to the art panel such that a major portion of a display of the progressive meter is viewable through at least a portion of the art panel.

5. The gaming terminal of claim 4, wherein the display of the progressive meter includes a plurality of light emitting diodes and wherein the display of the progressive meter is configured to directly display human readable content.

6. The gaming terminal of claim 4, wherein the video display is separate and distinct from and different than the progressive meter and wherein the display of the progressive meter has a resolution of no more than ten pixels by ten pixels per square inch and wherein the video display has a resolution of at least five hundred pixels by five hundred pixels per square inch.

7. The gaming terminal of claim 1, further comprising one or more illumination devices positioned within the second portion of the gaming cabinet and adjacent to the art panel such that at least a second region of the art panel is backlit by the one or more illumination devices, and wherein the video display is separate and distinct from and different than the one or more illumination devices.

8. The gaming terminal of claim 7, wherein the one or more illumination devices include one or more light emitting diodes, one or more incandescent light bulbs, one or more halogen light bulbs, one or more fluorescent light bulbs, one or more high-intensity discharge light bulbs, or any combination thereof, and wherein the video display includes one or more plasma displays, one or more liquid crystal displays, one or more thin film transistor displays, one or more super liquid crystal displays, one or more light emitting diode displays, one or more organic light emitting diode displays, one or more active matrix organic light emitting diode displays, one or more light emitting diode-backlit liquid crystal displays, one or more retina displays, one or more laser video displays, or any combination thereof.

9. The gaming terminal of claim 7, wherein the one or more illumination devices are configured such that the one or more illumination devices do not directly display human readable content.

10. A gaming terminal for conducting a wagering game, the gaming terminal comprising:

a gaming cabinet including a first portion and a second portion positioned above the first portion of the gaming cabinet;

one or more symbol bearing reels positioned within the first portion of the gaming cabinet, the one or more symbol bearing reels being configured to indicate randomly selected outcomes for the wagering game;

a video display positioned within the second portion of the gaming cabinet and being configured to display pay indicia associated with the wagering game;

one or more illumination devices positioned within the second portion of the gaming cabinet and being configured to emit light; and an art panel including a demarcated clear portion through which at least a portion of the pay indicia is viewable, the art panel further including one or more printed indicia, the art panel being positioned within the second portion of the gaming cabinet and overlaying the video display and the one or more illumination devices such that (i) a first region of the art panel is illuminated by the video display, (ii) a second region of the art panel is illuminated by the one or more illumination devices, and (iii) the video display is configured to selectively conceal at least one of the one or more printed indicia.

11. The gaming terminal of claim 10, wherein the one or more printed indicia are positioned on the art panel such that at least a portion of the one or more printed indicia mask a portion of a housing of the video display.

12. The gaming terminal of claim 10, further comprising a progressive meter positioned within the second portion of the gaming cabinet and adjacent to the art panel such that a major portion of a display of the progressive meter is viewable through at least a portion of the art panel, and wherein the video display is separate and distinct from and different than the progressive meter and wherein the video display is separate and distinct from and different than the one or more illumination devices and wherein the progressive meter is separate and distinct from and different than the one or more illumination devices.

13. The gaming terminal of claim 12, wherein the resolution of the video display is at least five times greater than the resolution of the progressive meter.

14. The gaming terminal of claim 10, wherein at least a portion of the pay indicia displayed by the video display is human readable content, and wherein the one or more illumination devices are configured such that the one or more illumination devices do not directly display human readable content.

15. A gaming terminal for conducting a wagering game, the gaming terminal comprising:

a gaming cabinet;

a video display positioned within the gaming cabinet and being configured to display pay indicia associated with the wagering game; and an art panel including a demarcated clear portion through which the pay indicia is viewable, the art panel further including one or more printed indicia, the art panel being positioned within the gaming cabinet and overlaying the video display such that (i) a first region of the art panel is illuminated by the video display and (ii) the video display is configured to selectively conceal at least one of the one or more printed indicia.

16. The gaming terminal of claim 15, further comprising one or more mechanical symbol bearing reels positioned within the gaming cabinet and being configured to indicate randomly selected outcomes for the wagering game.

17. The gaming terminal of claim 16, further comprising one or more illumination devices positioned within the gaming cabinet and adjacent to the art panel such that a second region of the art panel is illuminated using the one or more illumination devices, the video display being separate and distinct from the one or more illumination devices, wherein the one or more illumination devices are not capable of displaying information associated with the wagering game.

18. The gaming terminal of claim 17, further comprising a progressive meter positioned within the gaming cabinet and adjacent to the art panel such that a display of the progressive meter is viewable through at least a portion of the art panel, the resolution of the video display being at least ten times greater than the resolution of the progressive meter.

* * * * *